US006257143B1

(12) United States Patent
Iwasaki et al.

(10) Patent No.: US 6,257,143 B1
(45) Date of Patent: Jul. 10, 2001

(54) ADJUSTMENT METHOD OF DOT PRINTING POSITIONS AND A PRINTING APPARATUS

(75) Inventors: Osamu Iwasaki, Tokyo; Naoji Otsuka, Yokohama; Kiichiro Takahashi, Kawasaki; Hitoshi Nishikori, Inagi; Minoru Teshigawara, Urawa; Toshiyuki Chikuma, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/350,932

(22) Filed: Jul. 12, 1999

(30) Foreign Application Priority Data

Jul. 21, 1998 (JP) ..... 10-205705

(51) Int. Cl.[7] ..... B41F 1/34

(52) U.S. Cl. ..... 101/481; 400/76; 400/70; 400/61; 400/74; 347/9; 347/19

(58) Field of Search ..... 101/484, 485, 101/486, 481; 347/19, 9; 400/76, 70, 61, 74

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,473,298 | * | 9/1984 | Sakamoto | 358/432 |
| 4,558,333 | | 12/1985 | Sugitani et al. | 347/65 |
| 4,680,645 | * | 7/1987 | Dispoto et al. | 358/298 |
| 4,723,129 | | 2/1988 | Endo et al. | 347/56 |
| 4,740,796 | | 4/1988 | Endo et al. | 347/56 |
| 5,189,521 | * | 2/1993 | Ohtsubo et al. | 358/296 |
| 5,285,220 | * | 2/1994 | Suzuki et al. | 346/140 |
| 5,438,437 | * | 8/1995 | Mizoguchi et al. | 358/518 |
| 5,469,267 | * | 11/1995 | Wang | 358/298 |
| 5,530,460 | | 6/1996 | Wehl | 347/19 |
| 6,161,914 | * | 12/2000 | Haselby | 347/19 |
| 6,179,402 | * | 1/2001 | Suzuki et al. | 347/19 |

FOREIGN PATENT DOCUMENTS

| | | |
|---|---|---|
| 0 540 245 | 5/1993 | (EP) . |
| 0 622 237 | 11/1994 | (EP) . |
| 0 663 295 | 7/1995 | (EP) . |
| 0 778 150 | 6/1997 | (EP) . |
| 54-56847 | 5/1979 | (JP) . |
| 59-123670 | 7/1984 | (JP) . |
| 59-138461 | 8/1984 | (JP) . |
| 60-71260 | 4/1985 | (JP) . |
| 5-185698 | 7/1993 | (JP) . |
| 97/14563 | 4/1997 | (WO) . |

* cited by examiner

*Primary Examiner*—John S. Hilten
*Assistant Examiner*—Charles H. Nolan, Jr.
(74) *Attorney, Agent, or Firm*—Fitzpatrick, Cella, Harper & Scinto

(57) ABSTRACT

A plurality of patterns respectively having different area factor of dot formation area are formed by forward and reverse scanning printing of a print head, and then optical characteristics of the plurality of formed patterns are measured. A function representing the relationship between the printing position offset between the forward and reverse printings is determined from the optical characteristics. Then, respective pattern having a predetermined area factor of dot formation area is formed by means of forward and reverse scanning where the speed is differentiated according to the mode of a printing apparatus, and then the optical characteristics of this pattern is measured. By applying this measured optical characteristics to the function, an adjustment value of the dot formation position conditions between the forward and reverse scans is obtained for each mode. This makes it easy to perform printing registration in a printing apparatus in the case of printing by a forward and reverse scan of a printing head or in the case of printing by means of a plurality of printing heads. In this case, operations by a user etc. are also unnecessary and are easily performed.

22 Claims, 26 Drawing Sheets

PATTERN (a)

PATTERN (b)

PATTERN (c)

PATTERN (d)

PATTERN (e)

PATTERN (f)

PATTERN (g)

PATTERN (h)

PATTERN (i)

ADJUSTMENT METHOD OF DOT PRINTING POSITIONS AND A PRINTING APPARATUS

This invention is based on patent application Ser. No. 205705/1998 filed on Jul. 21, 1998 in Japan, the content of which is incorporated herein by reference.

BACKGROUND OF THE INVENTION

1. Field of the Invention

The invention relates to a method for adjusting dot forming or depositing positions in dot matrix recording and a printing apparatus using the method. More particularly, the invention relates to a method for adjusting dot forming positions, which are applicable to printing registration in the case of bi-directionally printing by a forward and reverse scan of a print head or to printing registration in the case of printing by means of a plurality of print heads, and printing apparatus using the method.

2. Description of the Related Art

In recent years, office automation instruments such as the personal computer and the word processor, which is relatively cheap, are widely used, and an improvement in high-speed technique and an improvement in high image quality technique of various recording apparatuses for printing-out the information which are entered by the instruments are being developed rapidly. In recording apparatuses, a serial printer using a dot matrix recording (printing) method is a recording apparatus (a printing apparatus) which realizes printing with high speed or high image quality but with low cost. For such printers, which print at high speed, for example there is a bi-directional printing method, as well as which print in high image quality, for example, there is a multi scanning printing method.

(Bi-directional printing method)

To improve high-speed printing, in a printing head which has a plurality of printing elements (although it is also considered to increase the number of a printing elements and improve a scanning speed of the print head), bi-directional printing scans of the print head are performed.

Although, since there is usually the time required for paper-feeding and paper-discharging or the like, it does not become a simply proportional relation, in the bi-directional printing, a printing speed of approximately two times can be obtained as compared with the one-directional printing in the printing apparatus.

For example, when using the print head having 64 ejection openings arranged with 360 dpi (dots/inch) in printing density in a direction different from the printing scanning (main scanning) direction (for example, in a sub-scanning direction which is the feeding direction of the printing medium), a printing is performed on, a printing medium of A4 size set in the lengthwise direction, the printing can be completed by scanning approximately 60 times. The reason is that, in one-directional printing, each printing scanning is performed only at the time of the movement in the one direction from the predetermined scanning commencement position, and since non-printing scanning to the inverse direction for returning to the scanning commencement position from a scanning completion position is attended, reciprocation of approximately 60 times is required. On the other hand, printing is completed by reciprocating printing scanning of approximately 30 times in bi-directional printing, so that printing can be performed and since it becomes possible at a speed of approximately 2 times. As such, bi-directional printing can be considered to be an effective method for an improvement in a printing speed.

In order to register dot-forming positions (for example, for an ink jet printing apparatus, a deposition or landing position of ink) at a forward trip and a return trip together in such bi-directional printing, using a position detection means such as an encoder, based on the detecting position, printing timing is controlled. However, to form such a feedback controlled system causes an increase in the cost of the printing apparatus. As a result, it is difficult to realize this in a printing apparatus which is relatively cheap.

(Multi scanning printing method)

Secondly, a multi scanning printing method is explained as one example of an improvement in high image quality technique.

When printing is performed using a print head which has a plurality of printing elements, quality of the printed image depends on performance of a print head itself greatly. For example, in the case of the ink-jet print head, slight differences, which is generated in a print head manufacturing step, such as variations of a form of ink ejection openings and the elements for generating energy for ejecting ink such as an electro-thermal converting elements (ejection heaters), influence a direction and an amount of ejected ink, and result in an unevenness in density of the image which is formed finally thereby reducing the image quality.

Specific examples are described using FIGS. 1A to 1C and FIGS. 2A to 2C. Referring to FIG. 1A, a reference numeral 201 denotes a print head, and for simplicity, is constituted by eight nozzles 202 (herein, as far as not mentioned specifically, refer to the ejection opening, the liquid passage communicated with this opening and the element for generating an energy used for ink). A reference numeral 203 denotes the ink, for example, which is ejected as a drop from the nozzle 202. It is ideal that the ink is ejected from each ejection opening in an approximately uniform amount of discharge and in a justified direction as shown in this drawings. When such discharge is performed, as shown in FIG. 1B, ink dots which are justified in size are deposited or landed on the printing medium and, as shown in FIG. 1C, the uniform images are produced with no unevenness in density as a whole can be obtained.

However, there are the variations in the nozzles in the print head 20 actually as is mentioned above, and when printing is performed as mentioned above, as shown in FIG. 2A, the variations are caused in size of the ink drops and in the ejecting direction of ink discharged from nozzles and the ink drops deposited or landed on a printing medium as shown in FIG. 2B. In this drawing, part of the white paper there exists an area factor can not be served up to 100% periodically with respect to the horizontal scanning direction of the head, moreover, in contrast with this, the dots overlap each other more than required or white stripes as shown in the center of this drawing have been generated. A gathering of the landed dots in such condition forms the density distribution shown in FIG. 2C to the direction in which nozzles are arranged, and the result is that, so far as usually seen by eyes of a human, these objects are sensed as the unevenness in density.

Therefore, as a countermeasure of this unevenness in density, the following method has been devised. The method is described using FIGS. 3A to 3C and FIGS. 4A to 4C.

According to this method, in order that the printing with regard to the same region as shown in FIGS. 1 to 1C and FIGS. 2A to 2C is made to be completed, the print head 201 is scanned 3 times as shown in FIG. 3A and FIGS. 4A to 4C. The region defining four pixels which is a half of eight pixels as a unit in the direction of length in the drawing has been completed by two passes. In this case, the 8 nozzles of the print head are divided into a group of 4 nozzles of upper half and 4 nozzles of lower half in the drawing and the dots which one nozzle forms by scanning of one time are the dots that the image data are thinned into approximately a half in accordance with the certain predetermined image data arrangement. Moreover, at the second scanning, the dots are embedded in the image data of the half of the remaining and the regions defined four pixels as the unit are completed progressively. Hereinafter, the printing method described above is referred to as a multi scanning printing method.

Using such printing method, even when the print head 201 which is equal to the print head 201 shown in FIG. 2A are used, the influence to the printed image by the variations of each nozzle is reduced by half, whereby the printed image becomes as shown in FIG. 3B and no black stripe and white stripe as shown in FIG. 2B becomes easy to see. Therefore, the unevenness in density is fairly also mitigated as compared with the case of FIG. 2C as shown in FIG. 3C.

When such printing is performed, although at a first scanning and at a second scanning, the image data are mutually divided in a manner to be complementary to each other in accordance with a certain predetermined arrangement (a mask), usually, this image data arrangement (the thinned patterns) as shown in FIG. 4A to FIG. 4C, at every one pixel arranged in rows and columns, it is most general to use the formation which makes to form a checker or lattice matrix. In a unit printing region (here, four pixels), printing is completed by the first scanning which forms the dots into the checker or lattice pattern and the second scanning which forms the dots into the inverted checker or lattice pattern. Moreover, usually, travel (vertical scanning travel) of the printing medium between each main scanning is established at a constant, and in the case of FIGS. 3A to 3C and FIGS. 4A to 4C, is made to move every four nozzles equally.

(Dot alignment)

As an example of other improvements in high image quality technique in the dot matrix printing method, there is a dot alignment technique adjusting the dot depositing position. A dot alignment is an adjustment method adjusting the positions which the dots on the printing medium have formed by any means, and in general, the prior dot alignment has been performed as follows.

For example, a ruled line or the like is printed on a printing medium in depositing registration of the forward scan and the reverse scan upon reciprocal or bi-directional printing by adjusting printing timing in the forward scan and the reverse scan respectively, while a relative printing position condition in reciprocal scan is varied. The results of printing has been observed by a user oneself to select the printing condition where best printing registration is achieved, that is, the condition that printing is performed without offset of the ruled line or the like and to set the condition directly into the printing apparatus by entering through a key-operation or the like or to set the depositing position condition into the printing apparatus by operating a host computer through an application.

Moreover, the ruled line or the like is printed on the medium under printing in the printing apparatus having a plurality of heads, when printing is performed between a plurality of heads, while a relative printing position condition between a plurality of heads is varied, with the respective head. As is mentioned above, the optimum condition that best printing registration is achieved has been selected to vary the relative printing position condition to set the printing position condition into the printing apparatus every each head in the mentioned-above manner.

Here, the case where the offset of the dots has been occurred is described.

(Problems upon performing image-formation by bi-directional printing) Due to bi-directional printing, the following problems has been caused.

First, when the ruled line (the ruled line of the longitudinal direction) in the direction perpendicular to the horizontal scan of the print head is printed, between the ruled line element which is printed in the forward scan and the ruled line element which is printed in the reverse scan, the dot depositing positions are not registered and the ruled line is not formed into a straight line, but rather a difference in level occurs. This is referred to as a so-called "offset in ruled line", and this is considered to be the most general disorder which can be recognized by the usual users. In many cases, the ruled line is formed by a black color, however, though the offset in the ruled line has been understood as the problem where a monochrome image is formed generally, a similar phenomenon can be caused in the color image also.

When multi scanning printing is used along with bi-directional printing in order to improve in high image quality, even though in bi-directional printing the depositing positions are not registered, as an effect of the multi scanning printing the offset in the pixel level is not easy to be seen, but from a macroscopic viewpoint the entire image can be seen unequally and is recognized as an unpleasant figure by the user. This generally is called texture, and appears on the image in the specific period where there is the offset in the delicate depositing position, thereby being caused. In a strong image in contrast such as the monochrome it is easy to be seen, moreover, when for the printing medium capable of high-density printing such as a coat paper middle-tones printing is performed, it can be easily seen.

(Problems in the case of performing the image formation using a plurality of the print heads)

In the printing apparatus having a plurality of heads, the problems of the case where the offset in the depositing positions of the dots between a plurality of heads occurs is discussed below.

When the image printing is performed, several colors are combined to perform the image formation frequently, and it is general to use four colors which added black in addition to three primary colors of yellow, magenta and cyan and it is used most abundantly. When in the case where a plurality of print heads for printing these colors are used, there is the offset of the depositing positions between the print heads, depending upon the amount of the offset, when a different color one another is about to be printed on the same pixel, a deviation in color matching is caused. For example, magenta and cyan are used to form the blue image, and although the part that the dots of both colors are overlapped becomes blue, the part which is not overlapped each other does not become blue, so that the deviation in color matching (irregular color) that each independent color tone appears is caused. When this occurs partially, it does not become easy to be seen, but when this phenomenon occurs in the direction of scanning continuously, a band-shaped deviation in color matching with a certain specific width is caused, so that the image becomes unequal. In addition, in a region adjacent the image region in the case of in the regions of the same color, when there is no offset in the depositing positions of the dots, a uniform impression and color development differ between the image regions adjacent each other, so that the image that there is a sense of incongruity as the image is formed. Moreover, though this deviation in color matching does not become easy to be seen in the case of an ordinary paper, it becomes easy to be seen, when a favorable printing medium in color development such as a coat paper is used.

Moreover, in the case where a different color is printed on adjoining the pixel, when there is the offset in the depositing positions of the dot, the clearance, that is, the region which is not covered by the ink, the ground of the printing medium can be seen. This phenomenon frequently is called "white clearance", since the case of a white ground is frequent in the printing medium generally. This phenomenon is easy to be seen in an image high in contrast, and when a black image is formed as a colored back ground, the white clearance which no ink is deposited between a black and coloration, since a contrast between white and black is high, can be easily seen.

It is effective to perform the above-mentioned dot alignment in order to suppress the occurrence of the problems as mentioned above. However, the complicatedness that the user should observe the results which the depositing registration conditions are varied by the eyes to select the optimized the depositing registration condition to perform entering operations is accompanied, and moreover, since fundamentally, a judgment for obtaining the optimum printing position by observing through eyes is enforced on the user, the establishment which is not optimized can be set. Therefore, it is especially unfavorable to the user who is not accustomed to operation.

Moreover, the user spends time and effort at least two times since the user should print the image to perform the depositing registration and in addition, to perform conditional establishment after observing to perform judgments required, whereby upon realizing the apparatus or a system excellent in operability, it is not only desirable but also is disadvantageous from the viewpoint of time-consumption.

Namely, it has been desired strongly that the apparatus or system capable of printing the image at a high speed and with high-quality without occurring the problem on the image formation as mentioned above and the problem on the operability is realized at a low cost by registering the depositing position without using a feedback controlling means such as an encoder by an opened loop.

And more particularly, as many of recent printing apparatuses provide an operation mode for performing a printing where a rapid output has priority over the image quality, or provide the ability to select an operation mode for printing with a high image quality at the expense of low output speed, it is desirable to perform simply and rapidly an appropriate dot alignment according to these respective modes.

SUMMARY OF THE INVENTION

Therefore, the object of the invention is to realize a dot alignment method which is excellent in operational performance and low cost.

Moreover, the invention, without fundamentally causing the user to judge and adjust, is designed to detect the optical characteristics of the printed image to derive the adjustment condition of the optimum dot alignment from the detected results and to set the adjustment condition automatically and rapidly, thereby to improve the adjustment accuracy thereof.

In a first aspect of the present invention, there is provided a printing registration processing method for performing printing registration in a first printing and a second printing with respective to a printing apparatus for performing printing of an image by said first printing and said second printing with predetermined conditions of a dot forming position on a printing medium by using a printing head, said method comprising:

a first pattern forming step of forming a plurality of patterns respectively having different area factor of dot formation area is different by said first and/or second printing of said print head;

a first measuring step of measuring respective optical characteristics of said plurality of patterns formed;

a function determining step of determining a function showing the relationship between the printing position offset between said first and second printings and the optical characteristics, from the measured optical characteristics;

a second pattern forming step of forming a pattern having a predetermined area factor of dot formation area by said first printing and second printing;

a second measuring step of measuring the optical characteristics of the pattern formed by said second pattern formation step; and an adjustment value acquiring step of acquiring an adjustment value of a dot forming position condition between said first printing and said second printing, by applying the measured optical characteristics by said second measuring step.

In a second aspect of the present invention, there is provided a printing apparatus for performing printing of an image by a first printing and a second printing with predetermined conditions of a dot forming position on a printing medium by using a printing head, comprising:

a first pattern forming means for forming a plurality of patterns respectively having different area factor of dot formation area is different by said first and/or second printing of said print head;

a first measuring means for measuring respective optical characteristics of said plurality of patterns formed;

a function determining means for determining a function showing the relationship between the printing position offset between said first and second printings and the optical characteristics, from the measured optical characteristics;

a second pattern forming means for forming a pattern having a predetermined area factor of dot formation area by said first printing and second printing;

a second measuring means for measuring the optical characteristics of the pattern formed by said second pattern formation step; and an adjustment value acquiring means for acquiring an adjustment value of a dot forming position condition between said first printing and said second printing, by applying the measured optical characteristics by said second measuring means.

In a third aspect of the present invention, there is provided a printing system provided with a printing apparatus for performing printing of an image by a first printing and a second printing with predetermined conditions of a dot forming position on a printing medium by using a printing head, and a host apparatus for supplying an image data to said printing apparatus, comprising:

a first pattern forming means for forming a plurality of patterns respectively having different area factor of dot formation area is different by said first and/or second printing of said print head;

a first measuring means for measuring respective optical characteristics of said plurality of patterns formed;

a function determining means for determining a function showing the relationship between the printing position offset between said first and second printings and the optical characteristics, from the measured optical characteristics;

a second pattern forming means for forming a pattern having a predetermined area factor of dot formation area by said first printing and second printing;

a second measuring means for measuring the optical characteristics of the pattern formed by said second pattern formation step; and an adjustment value acquiring means for acquiring an adjustment value of a dot forming position condition between said first printing and said second printing, by applying the measured optical characteristics by said second measuring means.

In a fourth aspect of the present invention, there is provided a storage medium which is connected to an information processing apparatus and a program stored in which is readable by the information processing apparatus, said program being for making a printing system to perform a method for processing for performing printing registration in a first printing and a second printing with respective to a printing apparatus for performing printing of an image by said first printing and said second printing with predetermined conditions of a dot forming position on a printing medium by using a printing head, said method comprising:

a first pattern forming step of forming a plurality of patterns respectively having different area factor of dot formation area is different by said first and/or second printing of said print head;

a first measuring step of measuring respective optical characteristics of said plurality of patterns formed;

a function determining step of determining a function showing the relationship between the printing position offset between said first and second printings and the optical characteristics, from the measured optical characteristics;

a second pattern forming step of forming a pattern having a predetermined area factor of dot formation area by said first printing and second printing;

a second measuring step of measuring the optical characteristics of the pattern formed by said second pattern formation step; and an adjustment value acquiring step of acquiring an adjustment value of a dot forming position condition between said first printing and said second printing, by applying the measured optical characteristics by said second measuring step.

Incidentally, hereafter, the word "print" (hereinafter, referred to as "record" also) represents not only forming of significant information, such as characters, graphic image or the like but also represents to form an image, patterns and the like on the printing medium irrespective whether it is significant or not and whether the formed image elicited to be visually perceptible or not, in broad sense, and further includes the case where the medium is processed.

Here, the wording "printing medium" represents not only paper typically used in the printing apparatus but also cloth, plastic film, metal plate and the like and any substance which can accept the ink in broad sense.

Furthermore, the wording "ink" is to be understood in the broad sense similarly to the definition of "print" and should include any liquid to be used for formation of image patterns and the like or for processing of the printing medium.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Hereinafter, this invention is described in detail with reference to drawings. Moreover, hereafter, the case where the invention is applied to an ink jet printing apparatus and a printing system using this is described mainly.

1. Summary of Embodiments

In an adjustment method (printing registration) of a dot formation position (an ink-depositing position) and a printing apparatus according to embodiments of the invention, a forward printing and a reverse printing (equivalent to a first and a second printing respectively) in a bi-directional printing which an adjustment of the dot formation position should be performed mutually, or respective printing (a first printing and a second printing) by a plurality of print heads (e.g. two heads) are on the substantial same position on a printing medium. In addition, printing is performed thereon, varying registration conditions of the relative dot formation position, under a plurality of conditions upon the first printing and the second printing. Namely, varying the relative position condition of the first and the second printing, a pattern including a plurality of patches described below is formed.

Moreover, densities are read using an optical sensor mounted on a horizontal or main scanning member such as a carriage. Namely, the optical sensor on the carriage is moved to the respective position corresponding to the respective patch and a reflected optical density (or an intensity of the reflected light and a reflection factor) is measured successively. Then, by using the relative relation of those values, a function for calculating the relative print offset amount is determined.

Next, respective main scanning is performed for carriage speeds (a>b>c, supposing they are a, b and c respectively) corresponding to print modes (respective modes of rapid, normal and high resolution), and respective one patch presenting a predetermined overlap amount between a first and a second printings is printed, to measure the reflected optical density. The, the measured density is applied to the above function, to obtain optimal deposition or landing position conditions for each mode.

Here, an image pattern formed for such aforementioned adjustment, is to be set considering the accuracy provided by the printing apparatus and the print head. Concerning the first printing, the pattern elements having a width substantially equal to or more than the maximum offset amount of the accuracy of the depositing position which is predicted with reference to the accuracy may be printed on the printing medium. Concerning the second printing, the pattern elements of the same width is printed under the registration conditions of the respective depositing position. The depositing position condition can be adjusted with the equivalent to the accuracy of the position registration condition of the depositing position or the accuracy above that, according to this manner.

2. Example of a Printing Apparatus (2.1) Mechanical constitution

Figures 1A, 1B, 1C:
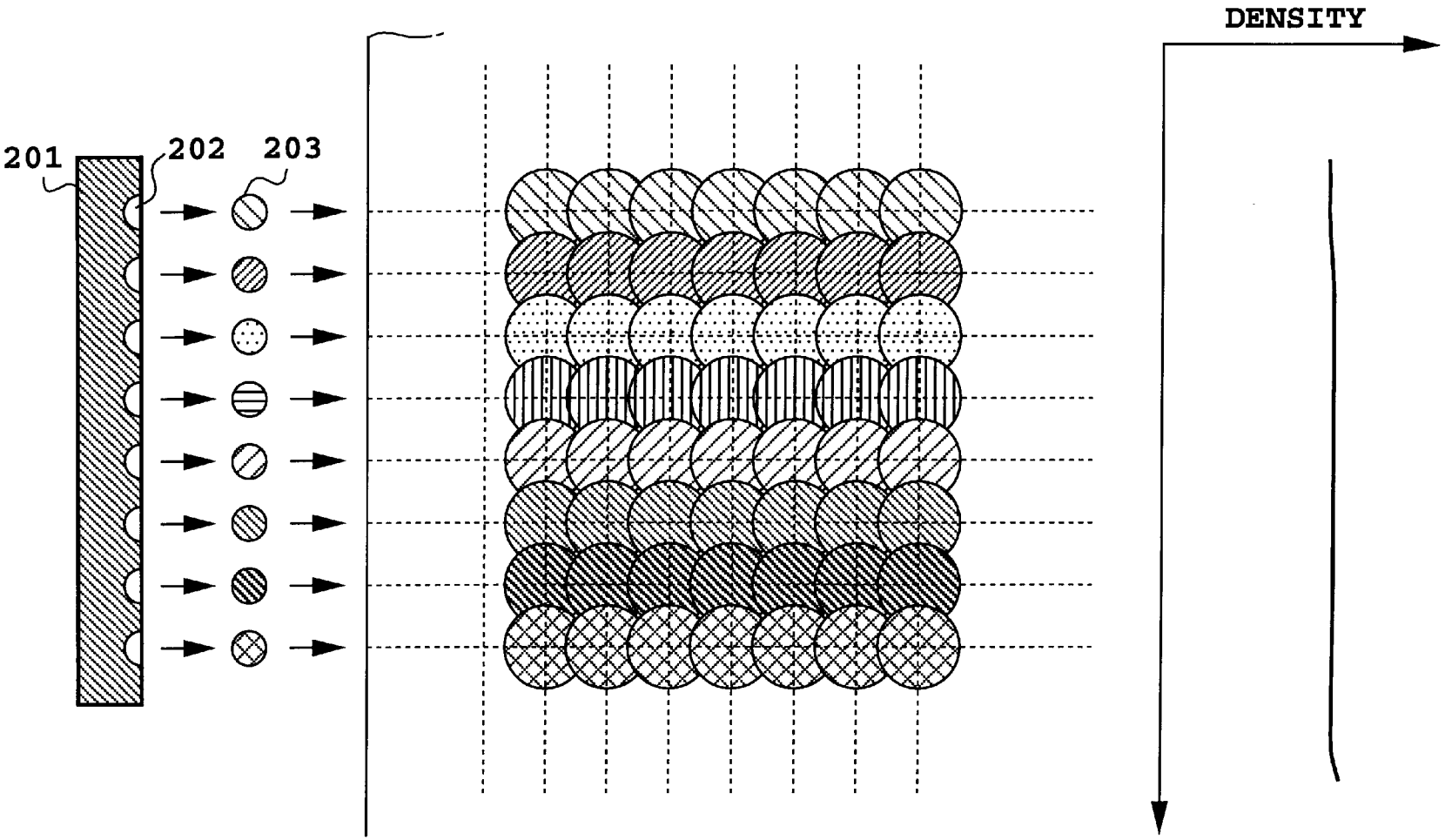
FIGS. 1A to 1C are illustrations for describing a principle of a dot matrix printing.
Figure 2C:
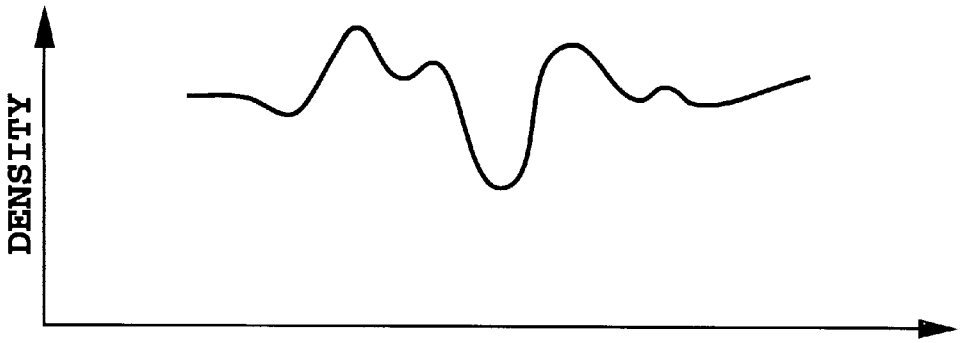
FIGS. 2A to 2C are illustrations for describing a generation of an unevenness in density which can occur in the dot matrix printing.
Figure 2B:
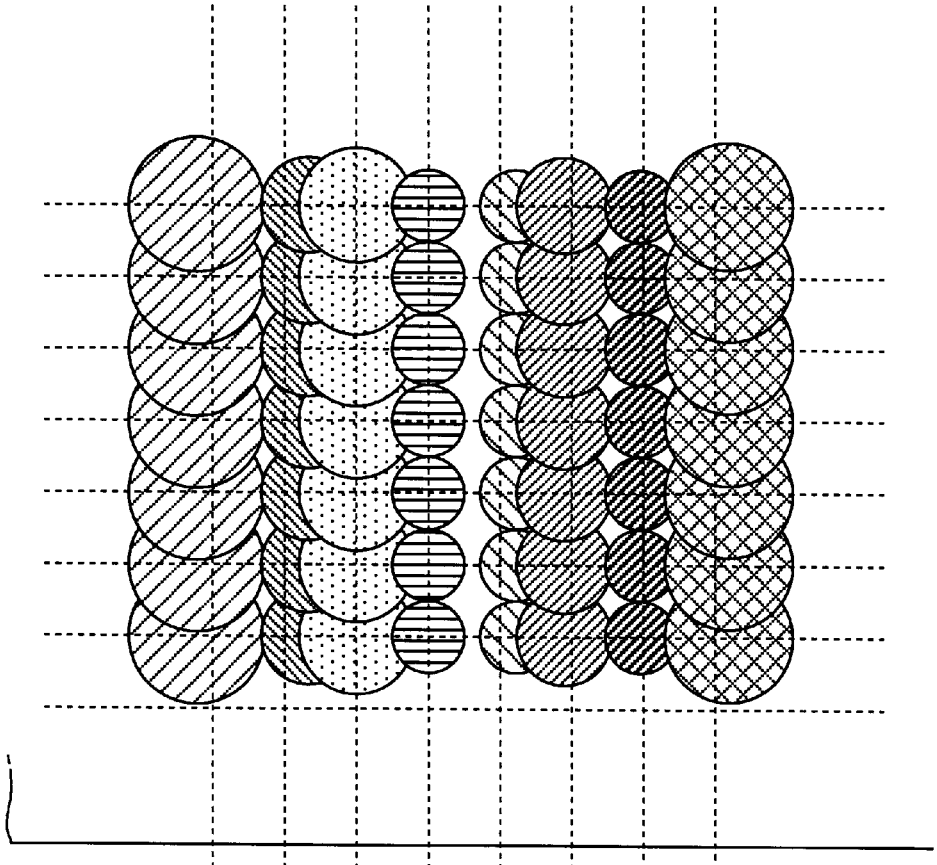
Figure 2A:
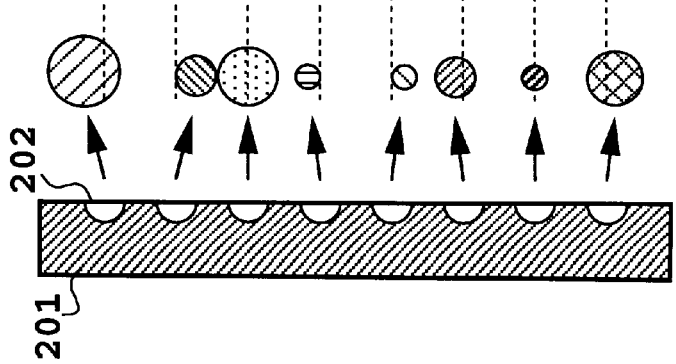
Figures 3A, 3B, 3C:
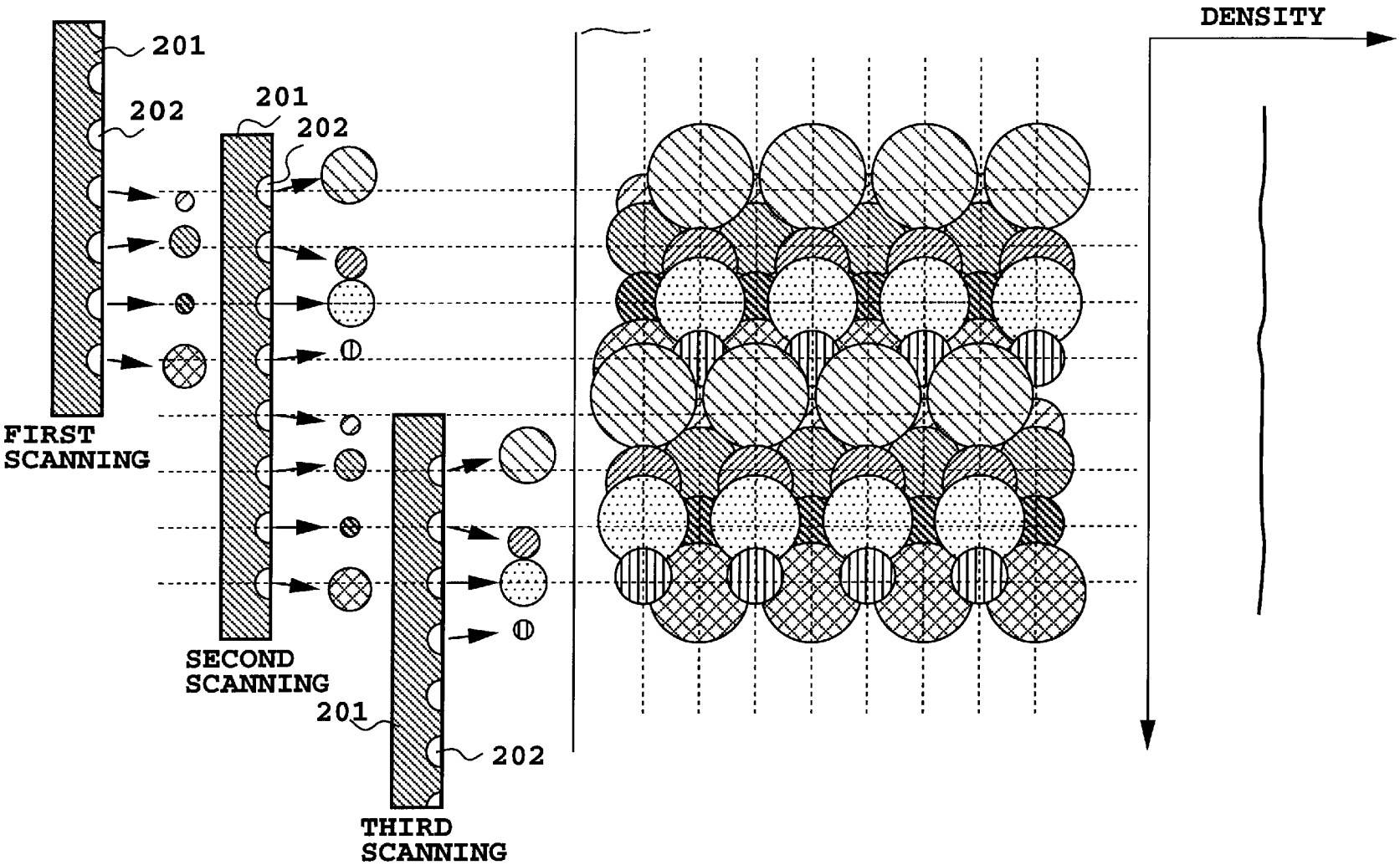
FIGS. 3A to 3C are illustrations for describing a principle of a multi scanning printing for preventing generation of unevenness in density described in FIG. 2A to 2C.
Figure 4A:
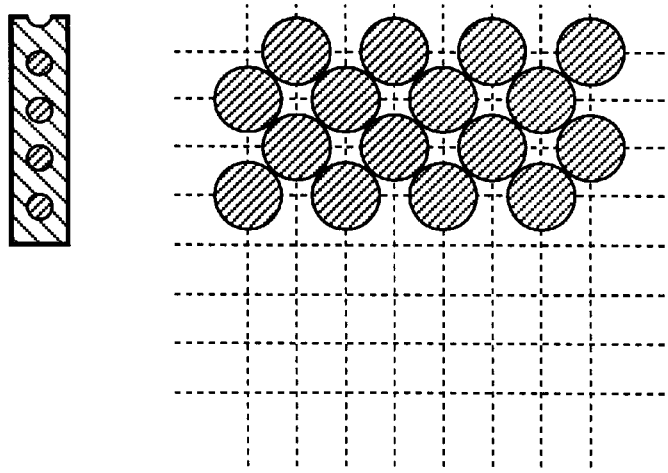
FIGS. 4A to 4C are illustrations for describing a checker or lattice arrangement printing and an inverted checker or lattice arrangement printing used in the multi scanning printing.
Figure 4B:
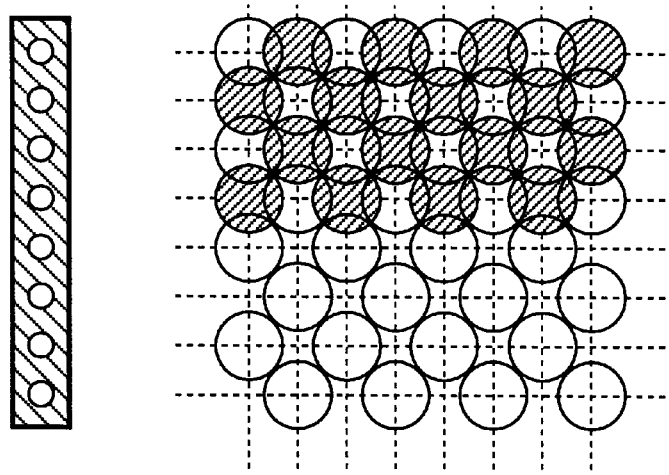
Figure 4C:
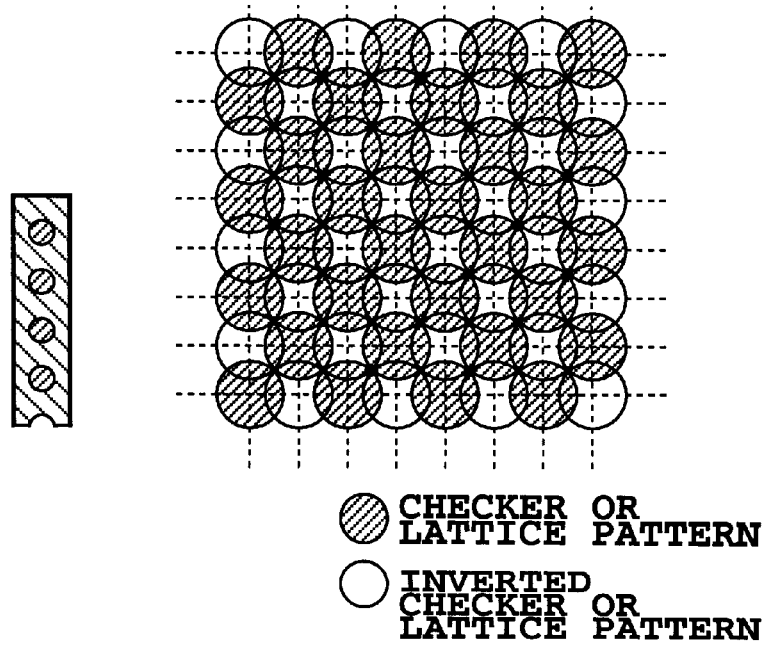
Figure 5:
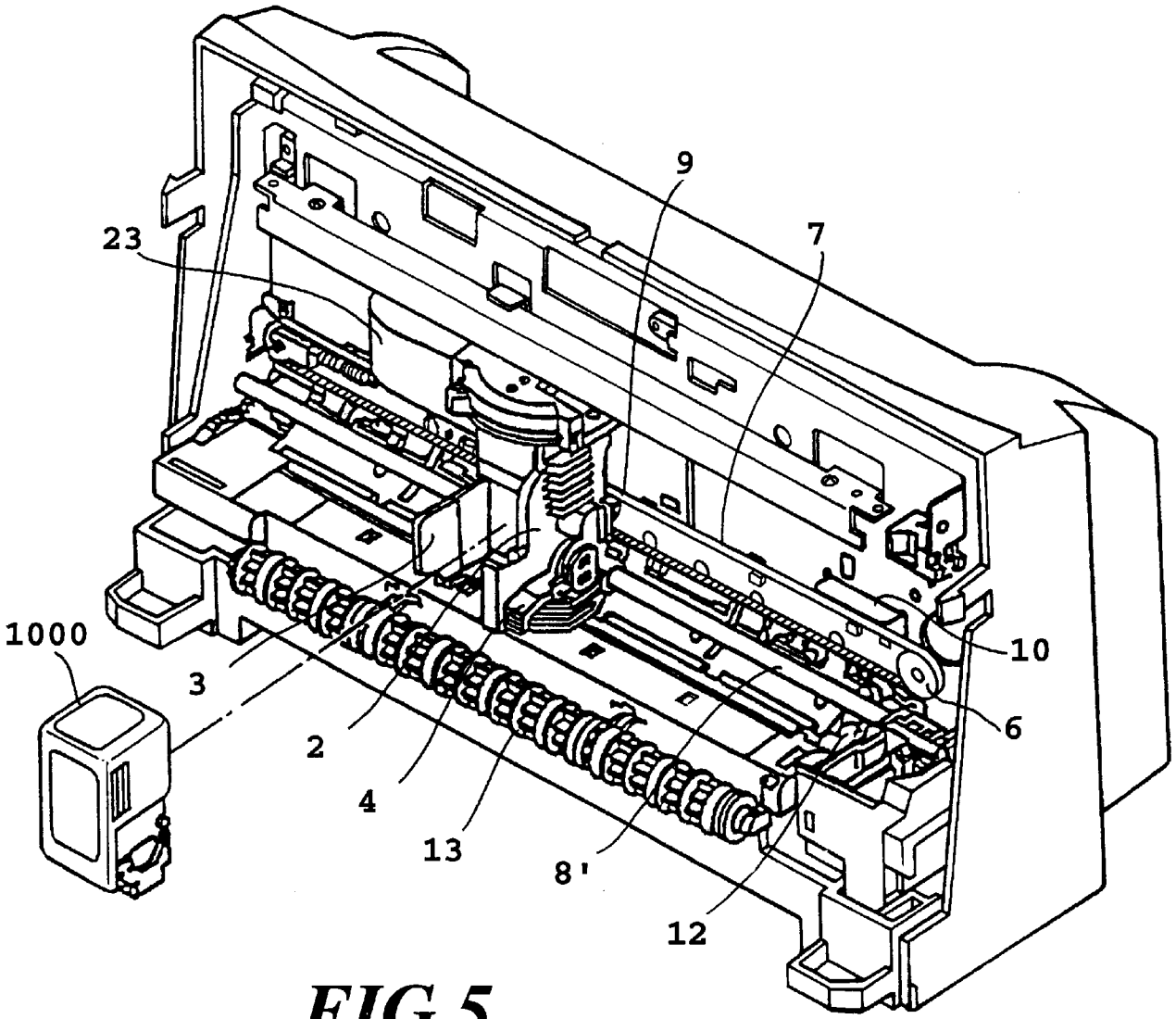
FIG. 5 is a perspective view showing a schematic constitution example of an ink jet printing apparatus according to one embodiment of the invention.

FIG. 5 is a perspective view showing an example of a color ink jet printing apparatus in which the invention is preferably embodied or to which the invention is preferably applied. The drawing illustrates a condition in which, detaching the front cover, an inside of an apparatus is exposed is shown.

In FIG. 5, a reference numeral 1000 denotes an exchangeable type head cartridge and a reference numeral 2 denotes a carriage unit retaining the head cartridge detachably. Reference numeral 3 denotes a holder for fixing the head cartridge 1000 on the carriage unit 2, and after the head cartridge 1000 is installed within the carriage unit 2, when the carriage fixing lever 4 is operated, linking to this operation, and the head cartridge 1000 is pressed on and contacted with the carriage unit 2. Moreover, when the head cartridge 1000 is located by the pressing and contacting, electric contacts for the required signal transmission, which are provided on the carriage unit 2, are in contact with electric contacts on the side of the head cartridge 1. Reference numeral 5 denotes a flexible cable for transferring electric signals to the carriage unit 2. Moreover, a reflective type optical sensor 30 (not shown in FIG. 5) is provided on the carriage.

Reference numeral 6 denotes a carriage motor as a driving source for allowing the carriage unit 2 to travel in the direction of the horizontal scanning reciprocally, and a reference numeral 17 denotes a carriage belt transferring the driving force to the carriage unit 2. Reference numeral 8' denotes a guide shaft for guiding the movement of the carriage unit 2, as well as there exists in a manner to extending in the direction of the horizontal scanning to support the carriage unit 2. Reference numeral 9 denotes a transparent-type photo coupler attached to the carriage unit 2, and reference numeral 10 denotes a light-shield board provided on the vicinity of the carriage home position, and when the carriage unit 2 reaches the home position, a light axis of the photo coupler 9 is shielded by the light-shield board 10, thereby the carriage home position being detected. Reference numeral 12 denotes a home position unit including a recovery system such as a cap member for capping a front face of the ink-jet head and suction means for sucking from the inside of this cap and further a member for performing wiping of the front face of the head.

Reference numeral 13 denotes a discharge roller for discharging the printing medium, and sandwiches the printing medium, cooperating with a spur-shaped roller (not shown) to discharge this out of the printing apparatus. Reference numeral 14 denotes line feed unit and to carry the printing medium in the direction of the vertical scanning by the predetermined amount.

Figure 6A:
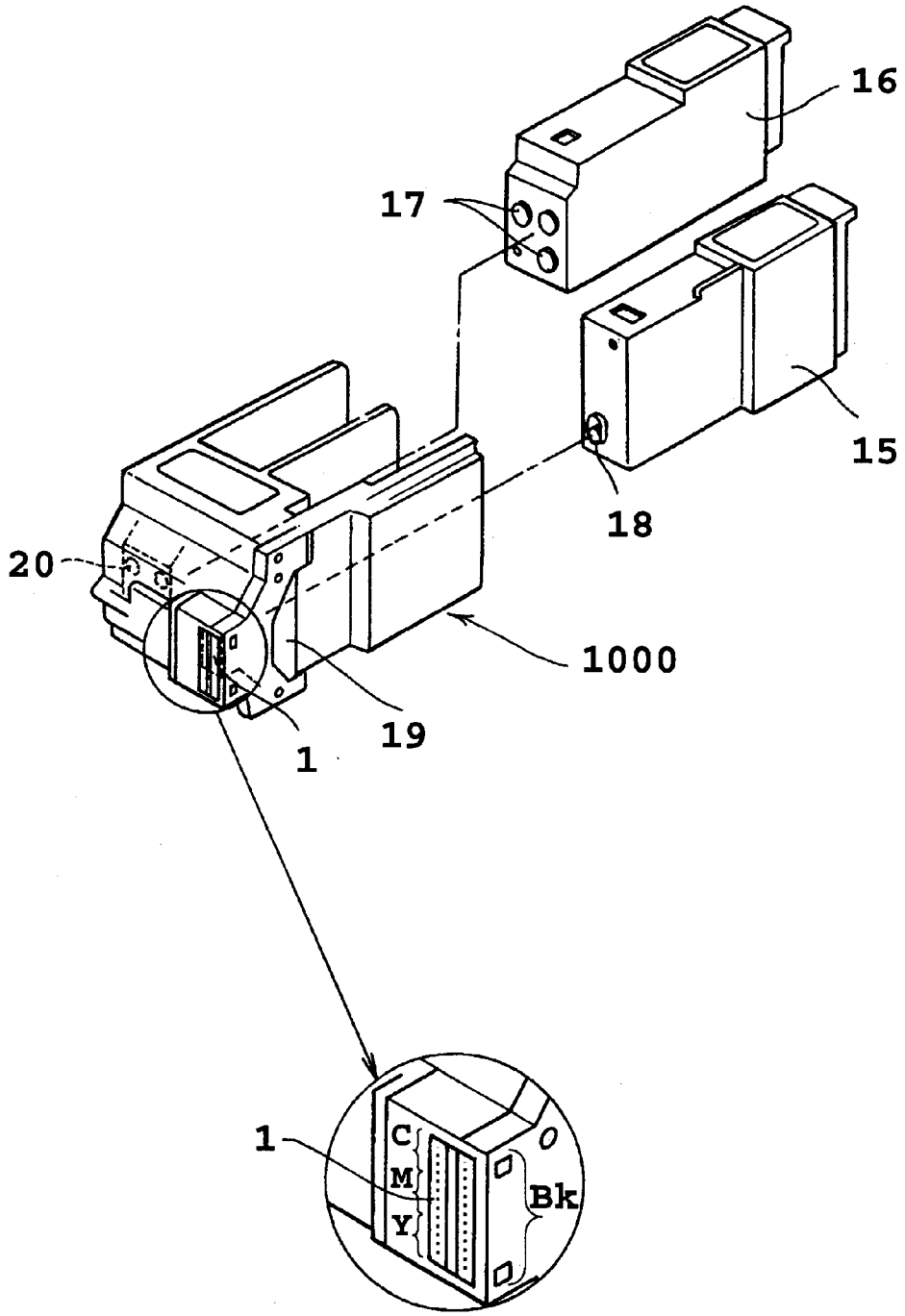
FIGS. 6A and 6B are perspective views showing a constitution example of a head cartridge shown in FIG. 5 and a constitution example of an ejection portion thereof respectively.

FIGS. 6A is perspective view showing a detail of a head cartridge 1000 shown in FIG. 5. Here, reference numeral 15 denotes an ink tank accommodating black ink, and reference numeral 16 denotes the ink tank accommodating a cyan, a magenta and a yellow ink. These tanks are designed to being able attach and detach to the head cartridge body. Each of portions denoted by reference numeral 17 is a coupling port for an each of ink supply pipes 20 on the side of the head cartridge accommodating each color inks, and similarly, a reference numeral 18 is a coupling port for the black ink accommodated in the ink tank 15, and by said coupling, the ink can be supplied to the print head 1 which is retained in the head cartridge body. Reference numeral 19 denotes an electric contact section, and accompanying with contact with an electric contact section provided on the carriage unit 2, through a flexible cable electric signals from the body of the printing apparatus control section can be received.

In this embodiment, a head which both a black ink ejecting portion arranging nozzles for ejecting the black ink and a color ink ejecting portion are arranged in parallel is used. The color ink ejecting portion comprises nozzle groups respectively ejecting yellow ink, magenta and cyan arranged unitarily and in line in response to a range of a black ejection opening arrangement.

Figure 6B:
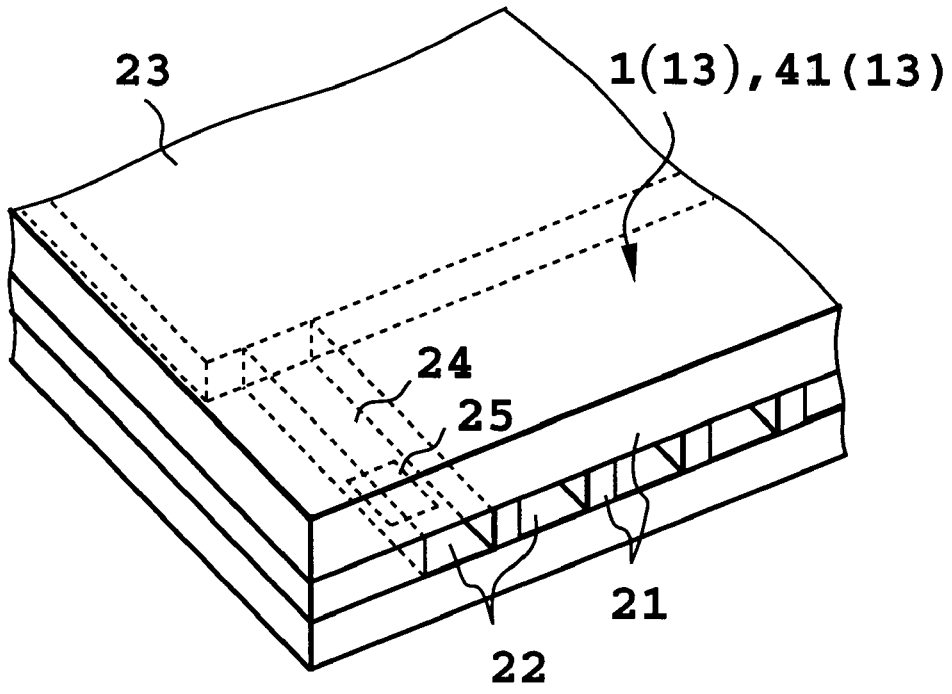

FIG. 6B is a schematic perspective-view partially showing a structure of a main portion of the print head portion 1 of the head cartridge 1000.

A plurality of ejection openings 22 are formed with the predetermined pitches on the ejection opening face 21 faced with the printing medium 8 spaced the predetermined clearance (for example, approximately 0.5 to 2.0 mm) in FIG. 6B, and along a wall surface of each liquid passages 24 communicating a common liquid chamber 23 with each ejection opening 22, the electrothermal converting elements (exothermic resistant element and so on) 25 for generating the energy used for ejecting ink ejection are arranged. In this embodiment, the head cartridge 1000 is installed on the carriage 2 under the positional relationship so that the ejection openings 22 stand in a line in the direction which crosses a scanning direction of the carriage unit 2. Thus, the print head 1 is constituted in that the corresponding exothermic resistant elements (hereinafter referred to as an ejecting heater) 25 are driven (energized) based on the image signal or ejection signals and to film-boil ink within the liquid passages 24 and to eject the ink from the ejection openings 22 by pressure of the bubbles which are generated by film-boiling.

In this embodiment, although the constitution was mentioned wherein within one print head body, a nozzle group for ejecting the black ink, and nozzle groups for ejecting yellow, magenta, cyan ink are provided and arranged, the invention can not be limited to this manner and the print head having the nozzle group for ejecting the black ink may be provided independent from the print head having the nozzle groups for ejecting the yellow, magenta, cyan ink, and still more, the head cartridges themselves may be independent from each other. Moreover, respective head cartridge may be provided by the nozzle groups of each color which are independent each other. The combination of the print head and the head cartridge is not especially limited.

Figure 7:
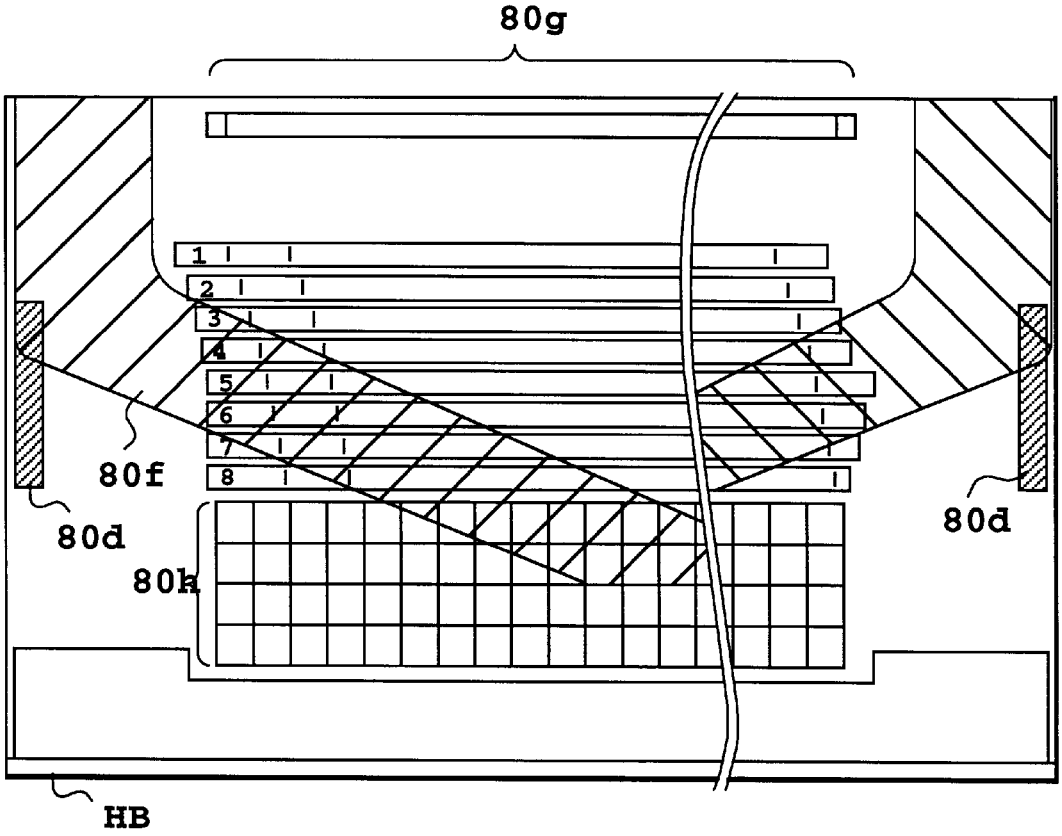
FIG. 7 is a plane view showing a constitution example of a heater board being used in the ejection portion shown in FIG. 6B.

FIG. 7 is a schematic view of a heater board HB being used in this embodiment. Temperature regulating heaters or sub heaters 80*d* for controlling temperature of the head, an ejection section row 80*g* in which ink ejecting heaters or main heaters 80*c* are arranged and a driving device 80*h* are formed on the same board under a positional relationship as shown in this drawing. The heater board is usually a chip of Si wafer and in addition, by an identical semiconductor deposition process each heater and the driving section required are formed thereon. By disposing these elements on the same board as mentioned above, it permits to detect and control the temperature of the head with high efficiency, and further, to make the head compact and simplify a fabricating process thereof.

Moreover, on the same drawing, especially, a positional relationship of an outside circumference wall section 80*f* of a ceiling board for separating a region which the heater board of ejection portion for the black ink is filled with the black ink from a region which is not so. The side of ejecting heaters 80*g* of the outside circumference wall section 80*f* of the ceiling board functions as the common liquid chamber. Moreover, by a plurality of grooves formed on the outside circumference wall section 80*f* corresponding to the ejection section row 80*g*, a plurality of liquid passages are formed. Although the color ink ejection sections of yellow, magenta and cyan are constituted in approximately the similar manner, for each ink, by forming the liquid passages for supplying and the ceiling board appropriately, separation or compartmentalization is performed such that different color inks are not mixed with each other.

Figure 8:
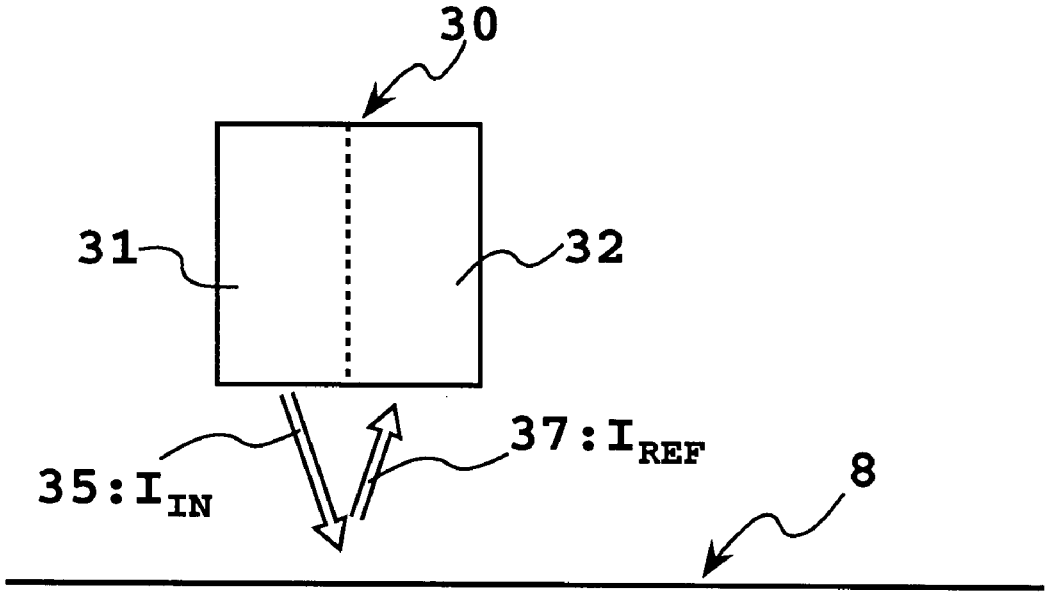
FIG. 8 is a schematic view describing an optical sensor being used in the apparatus shown FIG. 5.

FIG. 8 is a schematic view describing a reflection type optical sensor being used in the apparatus shown in FIG. 5.

The reflection type optical sensor 30 is mounted on the carriage 2 as described above, and comprises a light-emitting portion 31 and a photosensing portion 32 as shown in FIG. 8. A light Iin 35 which is emitted from the light-emitting portion 31 is reflected on the printing medium 8, and the reflected light Iref 37 can be detected by the photosensing portion 32. Moreover, the detected signal is transferred to a control circuit formed on an electric board of the printing apparatus through a flexible cable (not shown), and is converted into a digital signal by the A/D converter. The position which the reflective optical sensor 30 is attached to the carriage 2 is set at the position where the ejection opening section of the print head 1 does not pass in order to prevent splashed droplets of ink or the like from depositing, during printing scanning. This sensor 30 can be constituted a sensor of the low cost because of to be able to use a sensor of relatively low resolution.

(2.2) Constitution of control system

Secondly, a constitution of a control system for carrying out printing control of the described-above apparatus is described.

Figure 9:
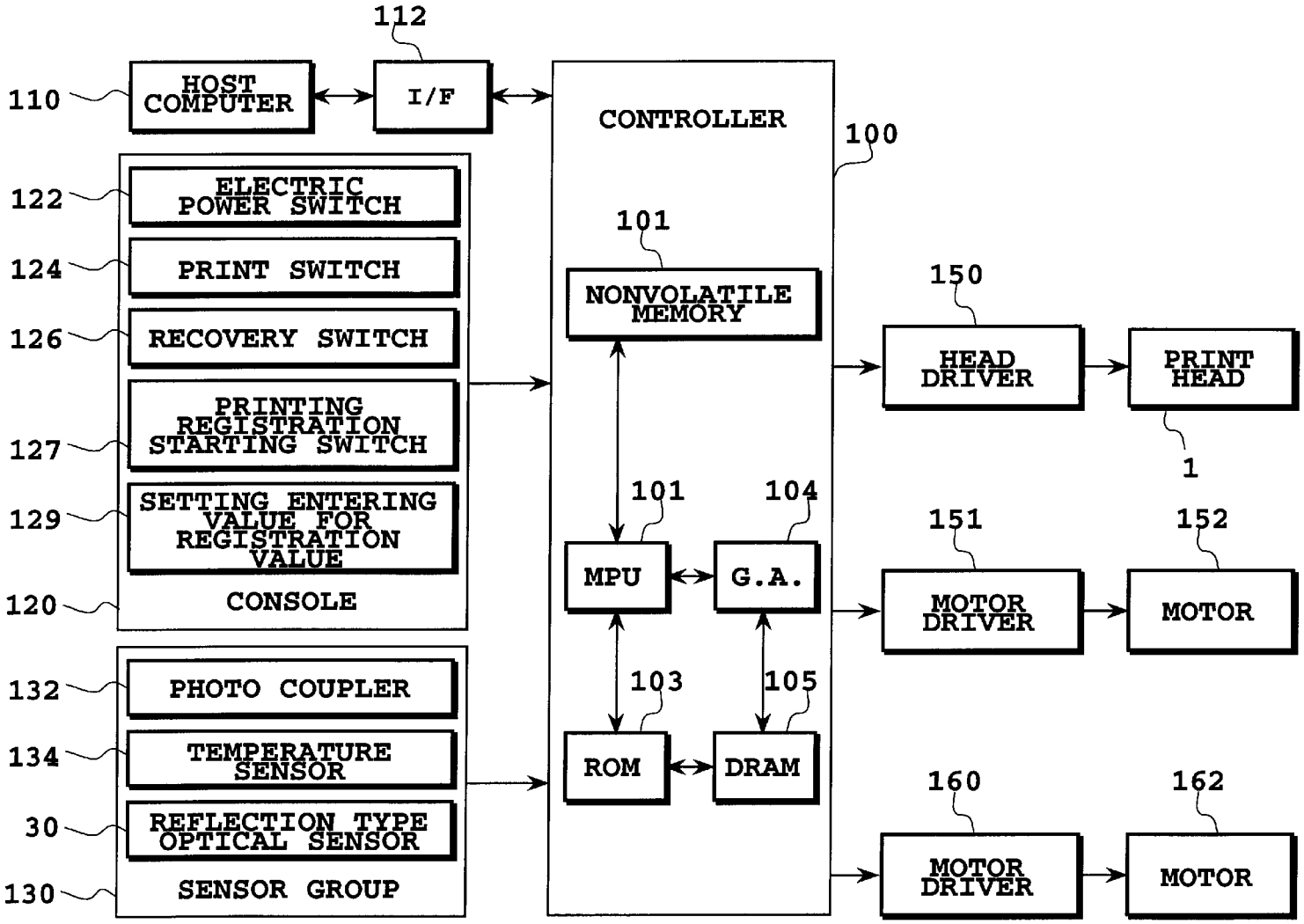
FIG. 9 is a block diagram showing a schematic constitution of a control circuit in the ink jet printing apparatus according to one embodiment of the invention.

FIG. 9 is a block diagram showing one example of the constitution of the control system. In this drawing, a controller 100 is a main control section and, for example, comprises MPU 101 of a microcomputer form, ROM 103 in which a program, a table required and the other fixed data are stored, nonvolatile memory 107 such as EEPROM for storing data adjustment data (may be data obtained every each mode described below) which are obtained by a dot alignment processing described below and are used in printing registration at the time of practical printing, a dynamic RAM in which various data (the described-above printing signal and printing data being supplied to the head or the like), and so on. The number of the print dots and the number of exchange of a print head also can be stored in this RAM 105. Reference numeral 104 denotes a gate array which performs supplying control of printing data to the print head 1, and transmission control of data between interface 112, MPU 101 and RAM 1106 and is also performed. A host apparatus 110 is a source of supply of the image data (a computer performing preparation of data and processing for printing is used, as well as the apparatus may be a form of a reader unit or the like for reading the image also). The image data, the other commands, a status signal or the like are transmitted to controller 100 and are received from controller 100 through the interface (I/F) 112.

A console 120 has a switch group which receives indicative input by an operator, and comprises a power supply switch 122, switch 124 for indicating commencement of printing, a recovery switch 126 for indicating starting of the suction recovery, a registration adjustment starting switch 127 for starting registration and an adjustment value set entering section 129 for entering said adjustment value by a manual operation.

Reference numeral 130 denotes a sensor group for detecting conditions of the apparatus, and comprises the above-mentioned reflective optical sensor 30, the photo coupler 132 for detecting the home position and a temperature sensor 134 provided on the appropriate region in order to detect an environment temperature or the like.

A head driver 150 is a driver for driving the ejection heaters 25 of the print head in response to printing data or the like, and comprises a timing setting section or the like for setting driving timing (ejection timing) appropriately for the dot-formation registration. Reference numeral 151 denotes a driver for driving a horizontal scanning motor 4, and a reference numeral 162 denotes a motor being used to carry (vertical scanning) the printing medium 8, and a reference numeral 160 denotes a driver thereof.

Figure 10:
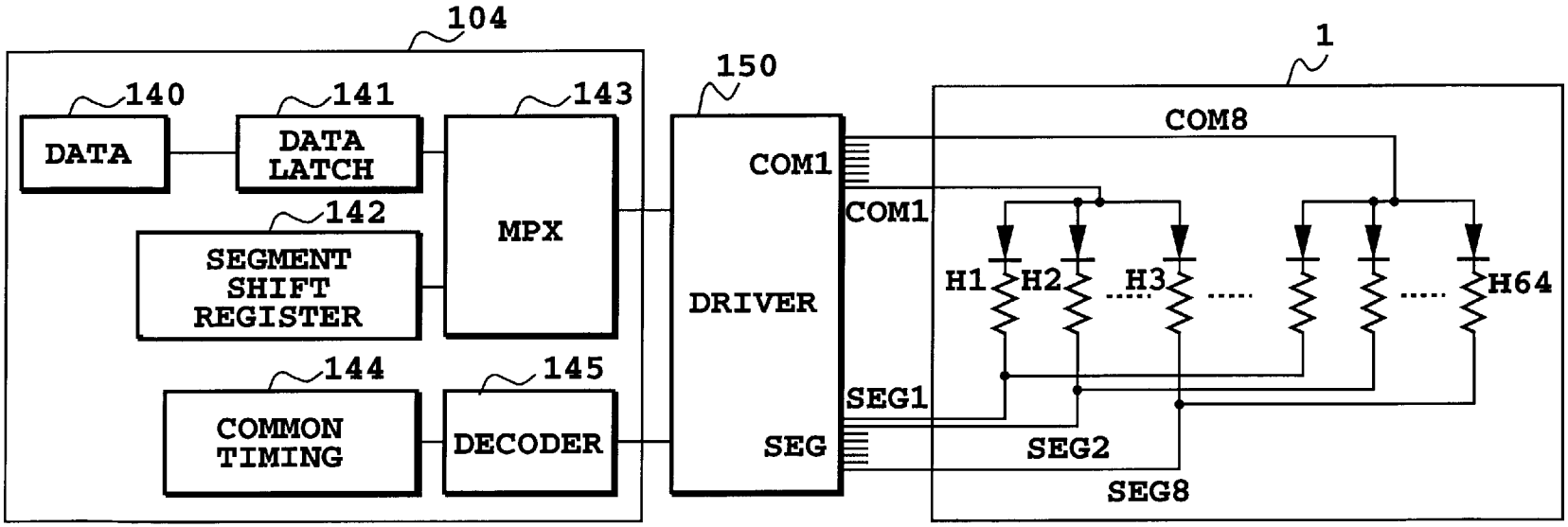
FIG. 10 is a block diagram showing an electric constitution example of a gate array and the heater board shown in FIG. 9.

FIG. 10 is one example of a circuit diagram showing a detail of each part 104, 150 and 1 of FIG. 9. A gate array 104 comprises a data latch 141, a segment (SEG) shift register 142, a multiplexer (MPX) 143, a common (COM) timing generating circuit 144 and a decoder 145. The print head 1 has a diode matrix, and driving currents flow to ejection heaters (H1 to H64) at the time where a segment signal SEG coincides with a common signal COM, thereby the ink is heated to eject the ink.

The decoder 145 decodes a timing generated by common timing generation circuit 144 to select any one of common signals COM 1 to COM 8. The data latch 141 latches the printing data read from RAM 105 every 8 bit, and a multiplexer 143 outputs the printing data in accordance with a segment shift register 142 as segment signals SEG 1 to SEG 8. The output from the multiplexer 143 can be changed every one bit, 2 bits or 8 bits all or the like according to contents of shift register 142 variously as described below.

Describing an operation of a configuration for controlling described below, when the printing signals enter the interface 112, the printing signals are converted into the printing data for printing between the gate array 104 and MPU 101. Moreover, the motor driver 151 and 160 are driven, as well as the print head is driven and printing is performed in accordance with the printing data sent to a head driver 150. Namely, here, although the case which drives the printing head of 64 nozzles has been described, control can be performed under even using the number of other nozzle by the similar configuration.

Figure 11:
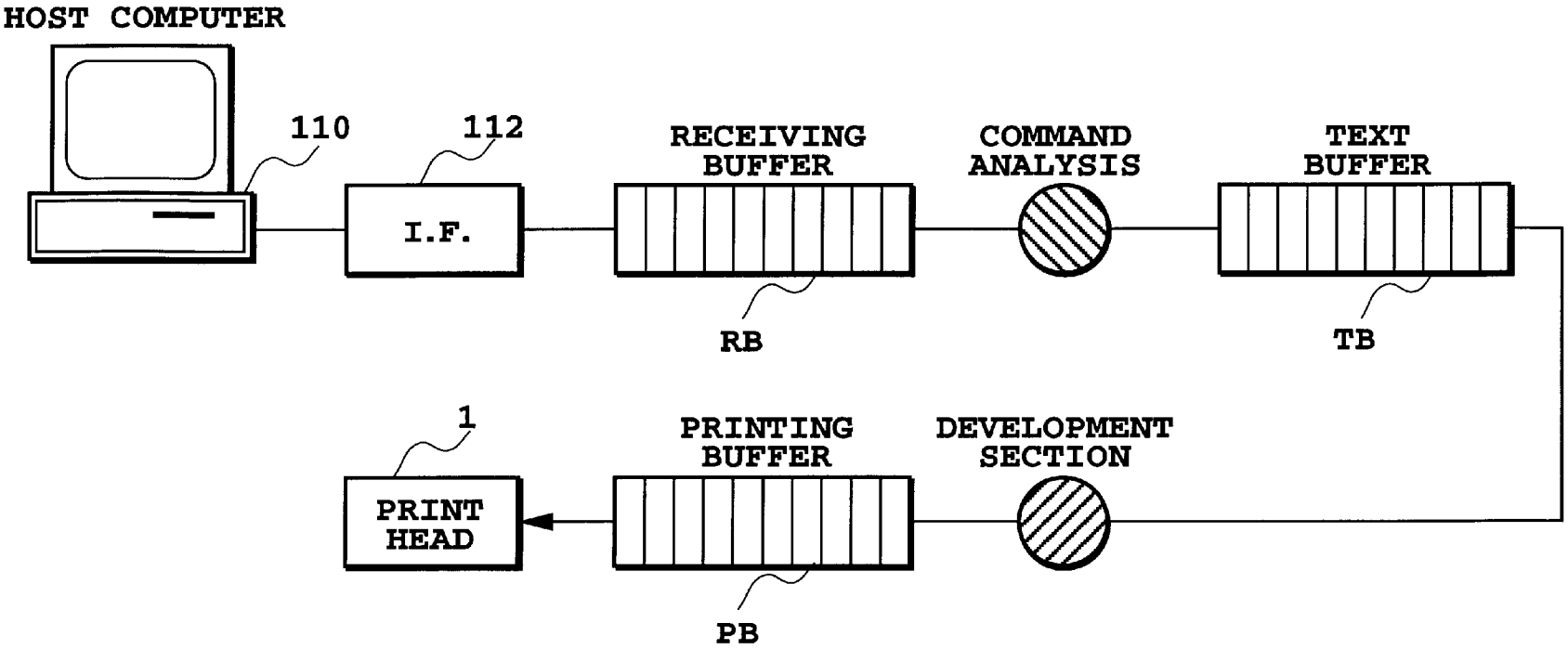
FIG. 11 is a schematic view for describing a stream of printing data in the inside of the printing apparatus from a host apparatus.

Secondly, a stream of the printing data in the inside of the printing apparatus is described using FIG. 11. The printing data sent from the host computer 110 are stored in the receiving buffer RB of the inside of the printing apparatus through an interface 112. The receiving buffer RB has a capacity of several kilobytes to tens of kilobytes. After a command analysis is performed with respect to the printing data stored in the receiving buffer RB, they are sent to a text buffer TB.

In a text buffer TB, printing data are maintained and as a intermediate form of one line, the processing which a printing position of each character, a kind of decoration, size, a character (code), an address of a font or the like are added is performed. A capacity of the text buffer TB differs depending upon the kind of the apparatus every each kind, and comprises a capacity of several lines in the case of a serial printer and a capacity of one page in the case of a page printer. Furthermore, the printing data stored in the text buffer TB are developed and are stored in a printing buffer PB in the binary-coded condition, and the signals are sent to the print head as the printing data and printing is performed.

The signals are sent to the print head after the binary-coded data stored in the printing buffer PB are covered with thinning mask patterns of a specific rate in this embodiment. Therefore, the mask patterns can be set after observing the data in the condition being stored in the printing buffer PB. There is also the apparatus of a kind that the printing data stored in the printing buffer PB are developed concurrent with a command analysis and to be written in the printing buffer PB without comprising the text buffer TB depending upon the kind of the printing apparatus.

Figure 12:
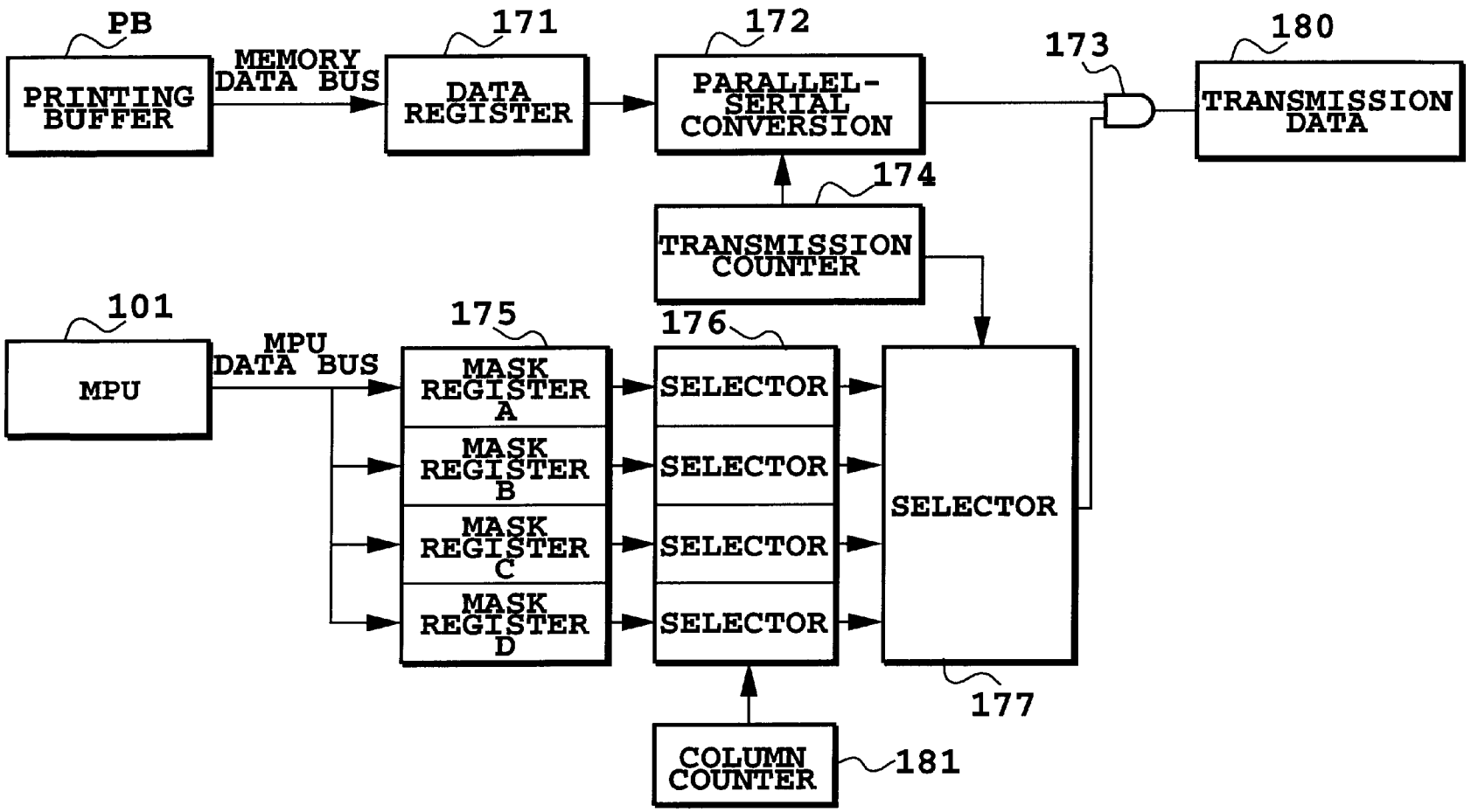
FIG. 12 is a block diagram showing a constitution example of a data transmission circuit.

FIG. 12 is a block diagram showing an example of a data transmission circuit, and such circuit can be provided as a part of controller 100. In this drawing, reference numeral 171 denotes a data register for connecting with a memory data bus to read the printing data being stored in the printing buffer in memory and to store temporarily and reference numeral 172 denotes a parallel-serial converter for converting the data stored in a data register 171 into a serial data, and reference numeral 173 denotes an AND gate for covering the serial data with the mask, and reference numeral 174 denotes a counter for controlling the number of data transmission.

Reference numeral 175 denotes a register which is connected with a MPU data bus and is for storing the mask patterns, and reference numeral 176 denotes a selector for selecting a column position of the mask patterns, and reference numeral 177 denotes a selector for selecting a row position of the mask patterns.

A data transmission circuit shown in FIG. 12 transfers serially the printing data of 128 bits to the print head 1 according to the printing signal being sent from MPU 101. The printing data stored in the printing buffer PB in memory are stored temporarily in a data register 171, and are converted into the serial data by a parallel-serial converter 172. After the converted serial data are covered by an AND gate 103 with the mask, the data are transferred on the print head 1. A transmission counter 174 counts the number of transmission bits to terminate the transmission when reaching 128 bits.

A mask register 175 is constituted by four pieces of the mask registers A, B, C and D to store a mask patterns written by the MPU. Each register stores the mask pattern of 4 bits row by 4 bits column. Moreover, a selector 176 selects the mask patterns data corresponding to the column position by providing the value of the column counter 181 as a selective signal. The transmission data is covered with the mask by the mask patterns data selected by the selector 176 and 177 using an AND gate 173.

In this example, four mask registers are used however, the other number of mask registers may be used. Further, the transmission data may be stored in a print buffer once, instead of directly supplying to the printing head 1 as mentioned above.

3. First Embodiment of Dot Alignment (Printing Registration) Processing

Figure 13:
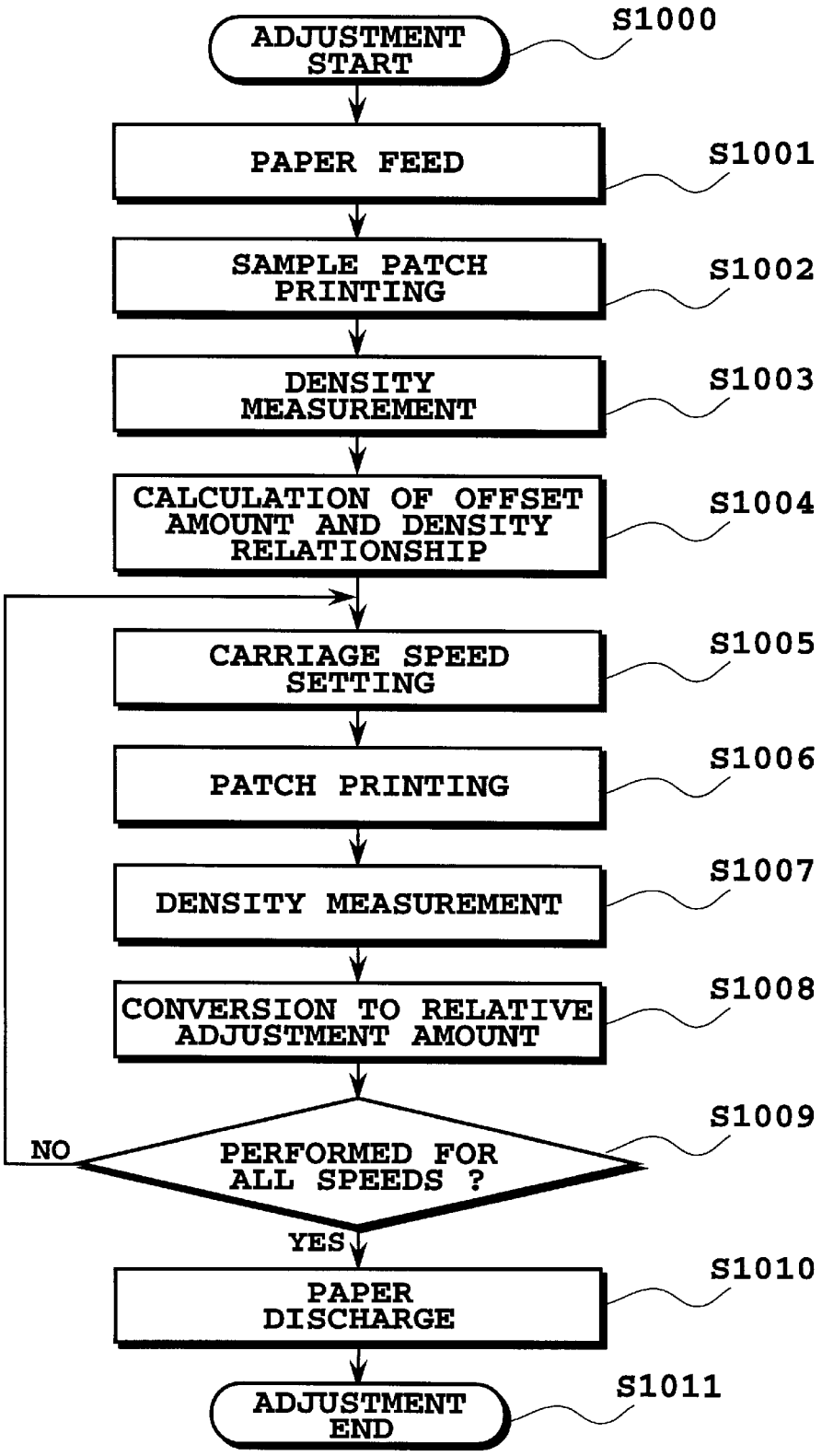
FIG. 13 is a flowchart showing one example of an entire algorithm of an automatic dot alignment processing capable of using in the invention.

FIG. 13 shows procedures of an automatic dot alignment processing in this embodiment. Here, means for starting this procedures may be a start switch disposed on a body of the printing apparatus, a command from an application on the host computer, and moreover, a timer starting at the moment of the apparatus turn-on, or other convenient means. Further, these may be combined.

Figure 14:
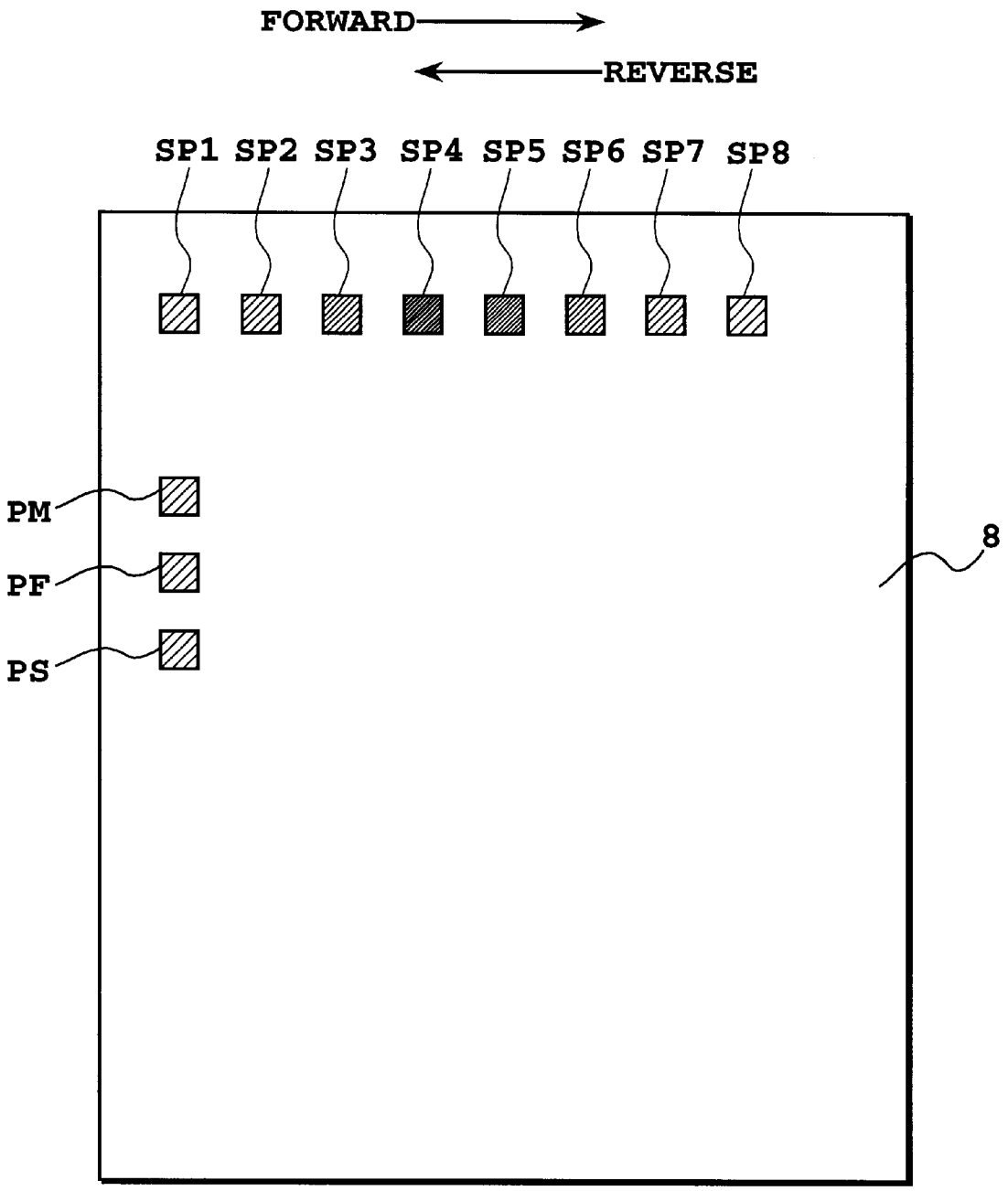
FIG. 14 is an illustration showing an example of patch group formed and measured during the processing shown in FIG. 13.
Figure 15A:
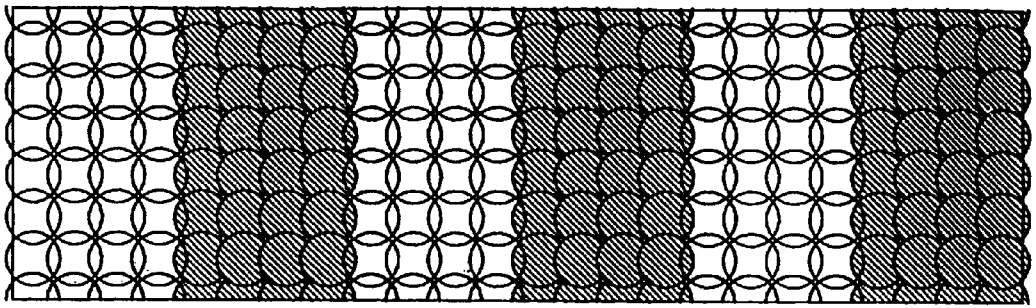
FIGS. 15A to 15C are illustrations for describing patterns formed by printing two pattern elements, in each of which a dot forming area for 4 dots and a blank area for 4 dots alternately appear in the main scanning direction, in such a manner that the two patterns are overlapped each other by shifting a predetermined amount between the first and second printings.
Figure 15B:
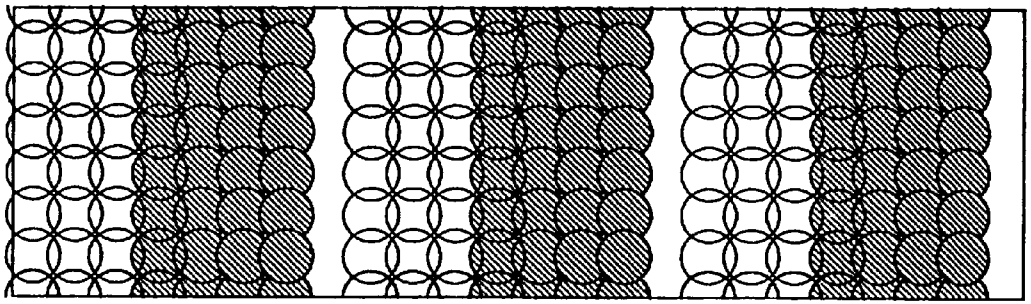
Figure 15C:
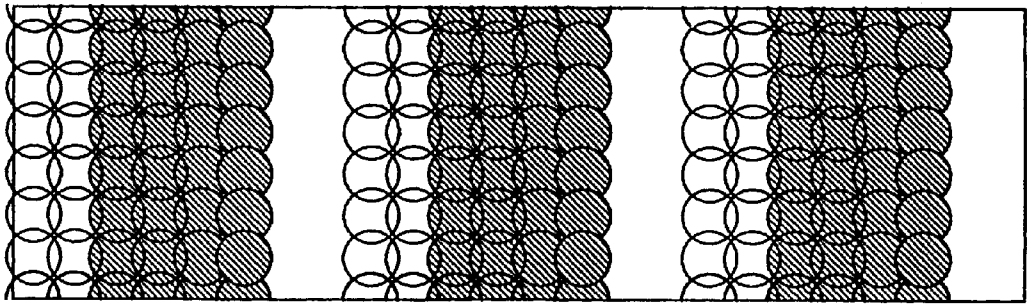
Figure 16A:
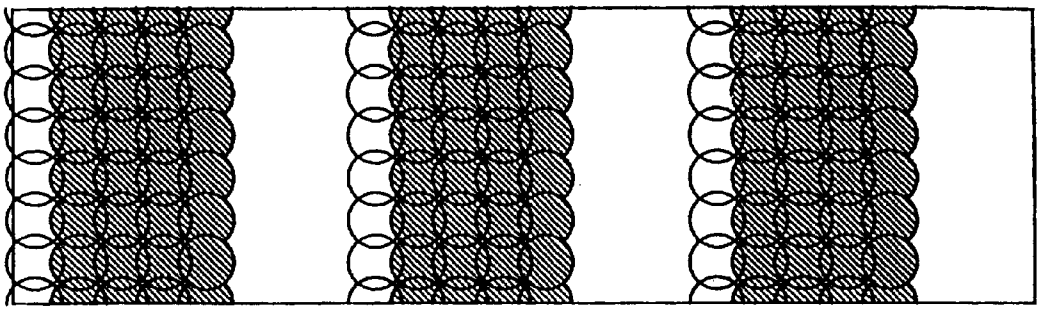
FIGS. 16A to 16C are illustrations for describing patterns formed by printing two pattern elements, in each of which a dot forming area for 4 dots and a blank area for 4 dots alternately appear in the main scanning direction, in such a manner that the two patterns are overlapped each other by shifting a predetermined amount between the first and second printings.
Figure 16B:
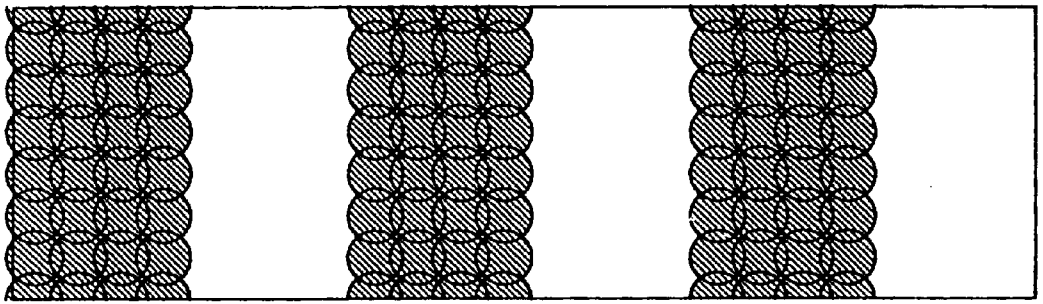
Figure 16C:
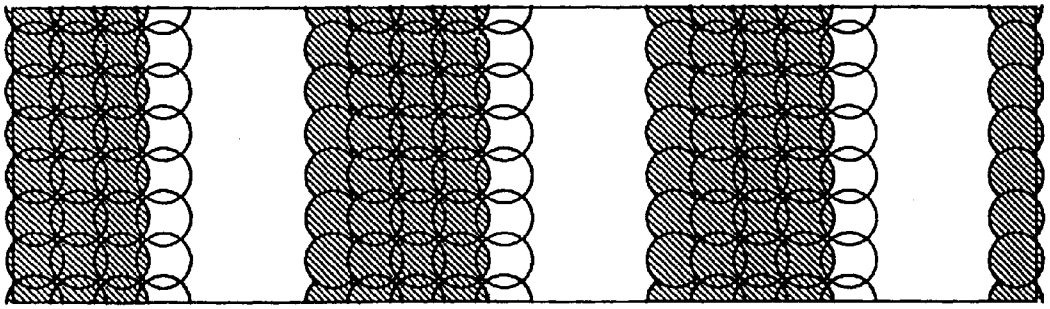
Figure 17A:
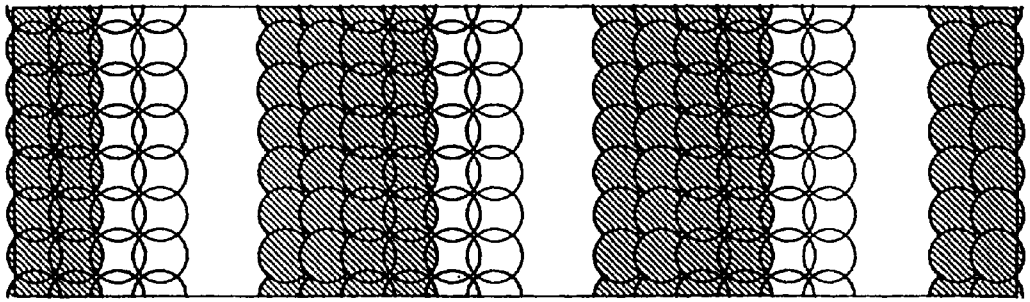
FIGS. 17A to 17C are illustrations for describing patterns formed by printing two pattern elements, in each of which a dot forming area for 4 dots and a blank area for 4 dots alternately appear in the main scanning direction, in such a manner that the two patterns are overlapped each other by shifting a predetermined amount between the first and second printings.
Figure 17B:
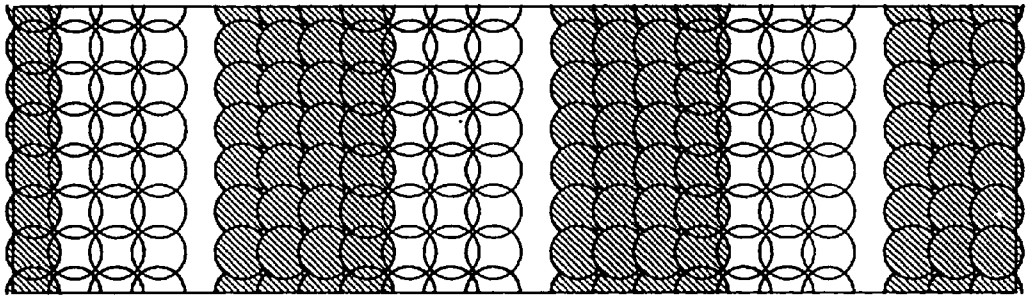
Figure 17C:
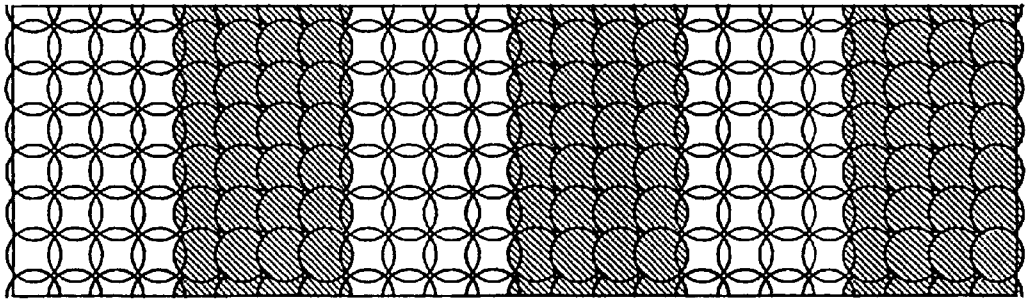

Moreover, FIG. 14 is an illustrative drawing of an example of a print pattern formed or used by the execution of the procedures.

When the procedures of FIG. 13 is started (step S1000), a printing medium 8 is fed to the printing position to form print patterns, and sample patches are formed first (step S1002).

Here, an adjustment between a forward printing and a reverse printing (corresponding respectively to the first printing and the second printing) in the bi-directional printing is supposed to be performed. First, in the forward direction, a patch element is created. For example, a patch element is created by driving, 8 times, the printing head to be processed. The patch element is a pattern in which a dot-forming area for 4 dots and a blank area for 4 dots appear alternately and repeatedly within a predetermined width, from a leftmost pixel column as the absolute position reference of respective patch to a right in the main scanning direction.

Next, sample patches SP1 to SP8 as described below are formed by driving the head to be processed, in the reverse scanning. They are namely:

SP1: a patch formed by overlapping a patch element in which a dot-forming area for 4 dots and a blank area for 4 dots appear alternately and repeatedly within a predetermined width, from right fifth pixel from the leftmost pixel column of the patch absolute position reference to the right, on the patch element formed in the forward scanning;

SP2: a patch formed by overlapping a patch element in which a dot-forming area for 4 dots and a blank area for 4 dots appear alternately and repeatedly within a predetermined width, from the leftmost pixel column of the patch absolute position reference to the right, on the patch element formed in the forward scanning;

SP3: a patch formed by overlapping a patch element in which a dot-forming area for 4 dots and a blank area for 4 dots appear alternately and repeatedly within a predetermined width, from right third pixel from the leftmost pixel column of the patch absolute position reference to the right, on the patch element formed in the forward scanning;

SP4: a patch formed by overlapping a patch element in which a dot-forming area for 4 dots and a blank area for 4 dots appear alternately and repeatedly within a predetermined width, from right second pixel from the leftmost pixel column of the patch absolute position reference to the right, on the patch element formed in the forward scanning;

SP5: a patch formed by overlapping a patch element in which a dot-forming area for 4 dots and a blank area for 4 dots appear alternately and repeatedly within a predetermined width, from right first pixel from the leftmost pixel column of the patch absolute position reference to the right, on the patch element formed in the forward scanning;

SP6: a patch formed by overlapping a patch element in which a dot-forming area for 4 dots and a blank area for 4 dots appear alternately and repeatedly within a predetermined width, from the leftmost pixel column of the patch absolute position reference to the right, on the patch element formed in the forward scanning;

SP7: a patch formed by overlapping a patch element in which a dot-forming area for 4 dots and a blank area for 4 dots appear alternately and repeatedly within a predetermined width, from left first pixel from the leftmost pixel column of the patch absolute position reference to the right, on the patch element formed in the forward scanning; and SP8: a patch formed by overlapping a patch element in which a dot-forming area for 4 dots and a blank area for 4 dots appear alternately and repeatedly within a predetermined width, from left second pixel from the leftmost pixel column of the patch absolute position reference to the right, on the patch element formed in the forward scanning.

In other words, each of the sample patches SP1 to SP8 is a pattern formed by overlapping a patch element of the repetition of a dot forming area for 4 dots and a blank area for 4 dots formed in the reverse scanning on a patch elements of the repetition of a dot forming area for 4 dots and a blank area for 4 dots formed in the forward scanning, by offsetting them by 1 dot, and it can be formed by shifting the print timing, or by offsetting the print data.

Then, the reflected light intensities of these sample patches are measured by means of the optical sensor 30 mounted on the carriage unit 2 (step S1003), to obtain a function for calculating the relative printing offset amount, from the relative relationship of these values (step S1004).

Now, the process for obtaining the function will be described in detail.

FIGS. 15A to 15C, FIGS. 16A to 16C and FIGS. 17A to 17C illustrate patterns each having the cyclic repetition of a dot-forming area for 4 dots and a blank area for 4 dots in the main scanning direction, where the outline dots represent dots to be formed on a printing medium in the forward scanning, while the hatched dots represent dots to be formed in the reverse scanning (the second printing). Though dots are hatched or not hatched in these drawings, the respective dots are those formed by ink ejected from a same print head in this embodiment, and they do not correspond to the dot color tone (color or density).

Moreover, these drawings show dots which are printed when printing positions are registered between the forward scanning and the reverse scanning, and patterns (a) to (g) in these drawings correspond respectively to the sample patches SP2 to SP8. Also, the pattern (h) corresponds to the sample patch SP1, or a patch composed of a repetition of a dot-forming area for 4 dots and a blank area for 4 dots from a left third pixel from the leftmost pixel column of the absolute position reference to the right for a patch element in the forward direction, while the pattern (i) corresponds to a patch composed of repetition of a dot-forming area for 4 dots and a blank area for 4 dots from a left fourth pixel from the leftmost pixel column of the absolute position reference to the right for a patch element in the forward direction, of which a density equal to the pattern (a) is to be measured by the optical sensor 30.

By the way, the input value to the density sensor is related to the reflected light intensity. Therefore, the reflected light intensity of the patterns (a) to (i) shown in FIGS. 15A to 15C, FIGS. 16A to 16C and FIGS. 17A to 17C are substantially proportional to the area factor of the non-printed portion where dots are not actually formed (substantially inversely proportional to the area factor of the printed portion) according to the expression of Yule Nielsen:

Sn/1=Aü~Sin/1+(1−A)Swn/1

(where, Sn: reflection factor, Si: reflection factor of a dot (ink dot) formation portion, Sw: reflection factor of a printing medium (white paper), A: area of a dot formation portion, n: correction coefficient taking light diffusion on the printing medium into consideration, normally nüα1).

Figure 18:
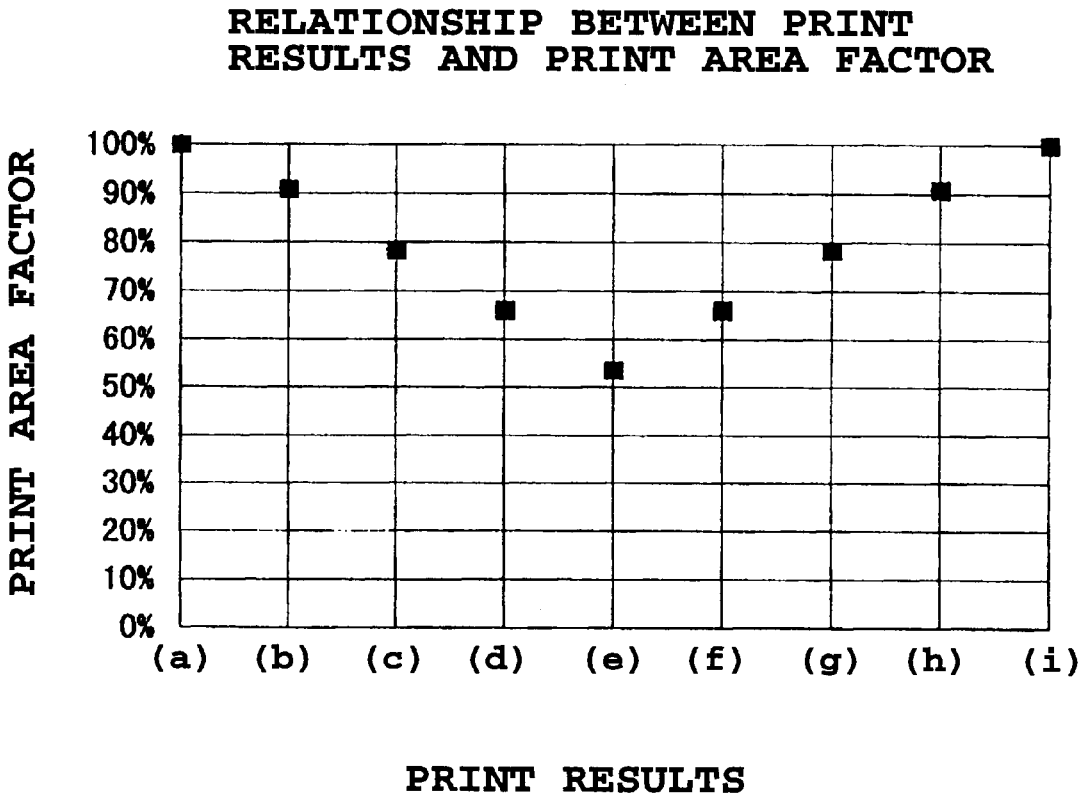
FIG. 18 is a graph showing relationship between print area factors and patterns (a) to (i) shown in FIGS. 15A to 15C, FIGS. 16A to 16C and FIGS. 17A to 17C.

FIG. 18 represents the area occupation factor on the printing medium of the patterns (a) to (i). Namely, in the pattern (e), because the print area factor is minimum, the reflected light intensity becomes maximum, while in the patterns (a) and (i), because the print area factor is maximum, the reflected light intensity becomes minimum. Therefore, the density measurement results of the sample patches SP1 to SP8 formed by an actual printing apparatus are dispersed at a state between the patterns (a) to (i) in FIG. 18 with a high probability.

Now the processing of an example of the density measurement results of the sample patches SP1 to SP8 will be described by referring to FIGS. 19 to 22. This example corresponds to a case where a print area factor as shown in FIG. 19 is obtained as the result of sample patch formation by means of a printing apparatus to be processed.

Figure 19:
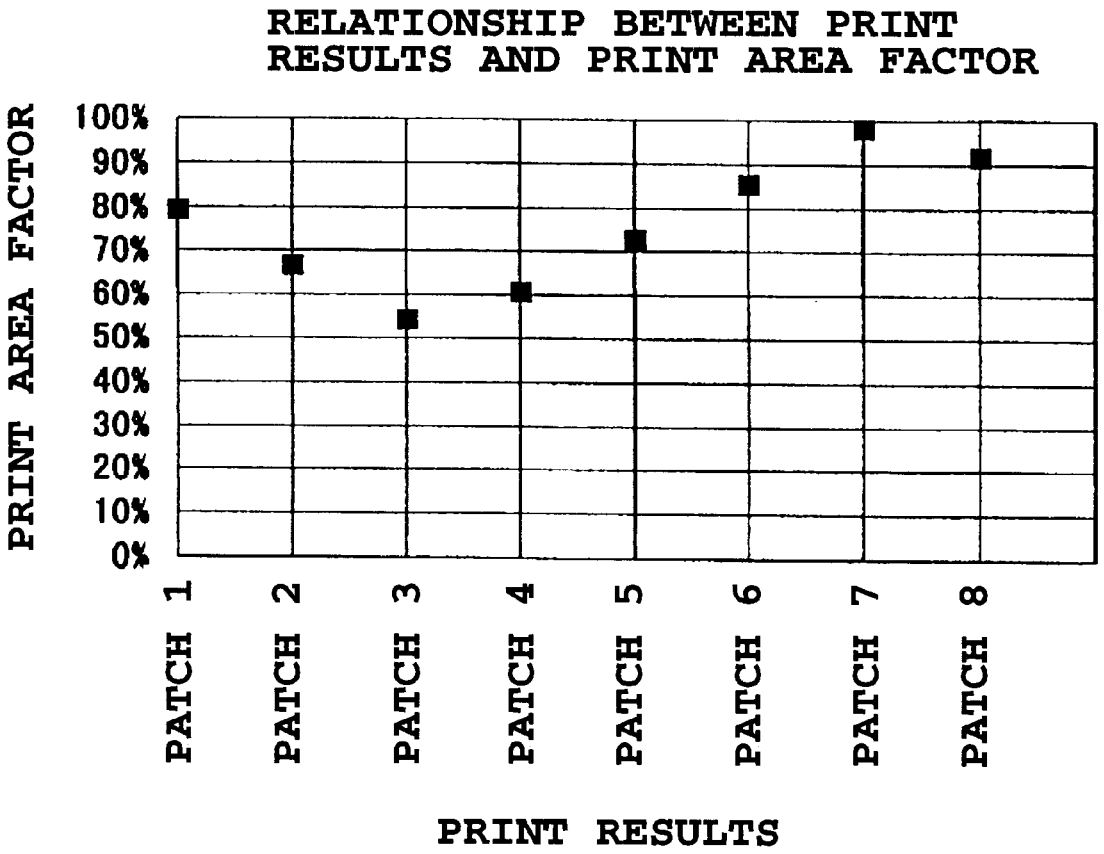
FIG. 19 is a graph showing relationship between print area factors and patterns (a) to (i) as shown in FIGS. 15A to 15C, FIGS. 16A to 16C and FIGS. 17A to 17C by a printing head targeted for a process of a dot alignment.
Figure 20:
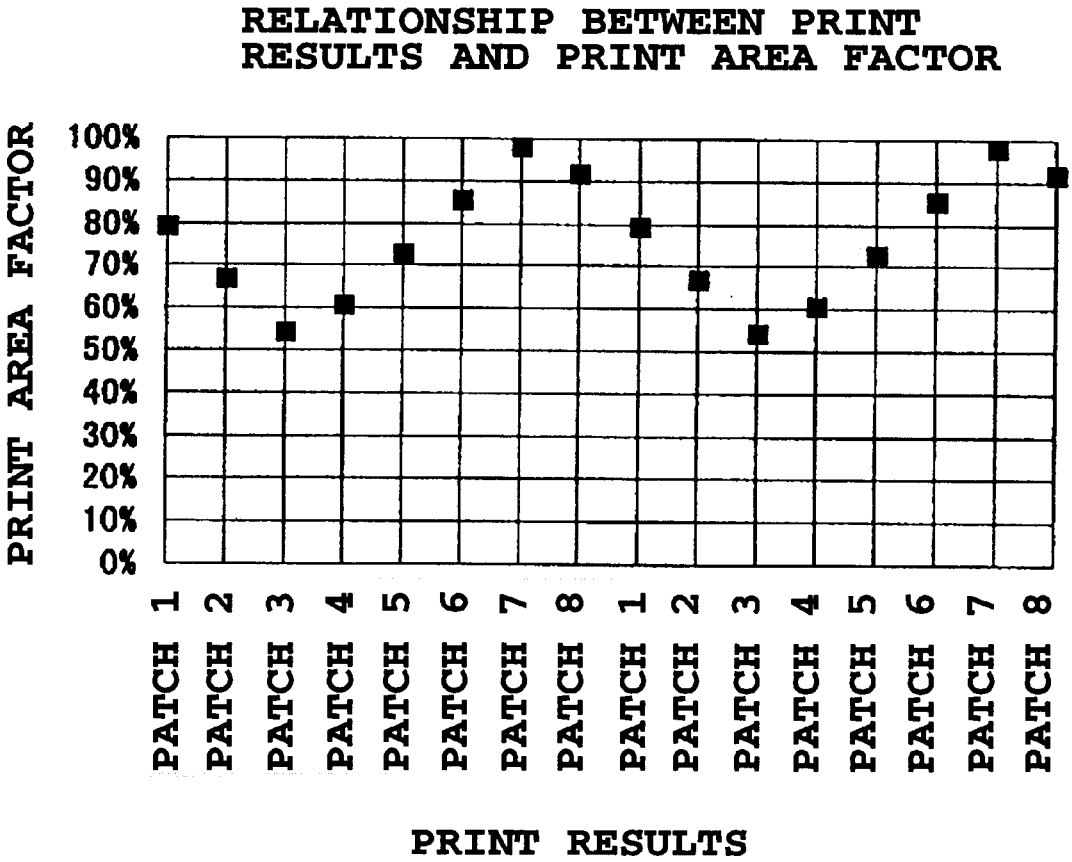
FIG. 20 shows that the relationship shown in FIG. 19 is periodical.
Figure 21:
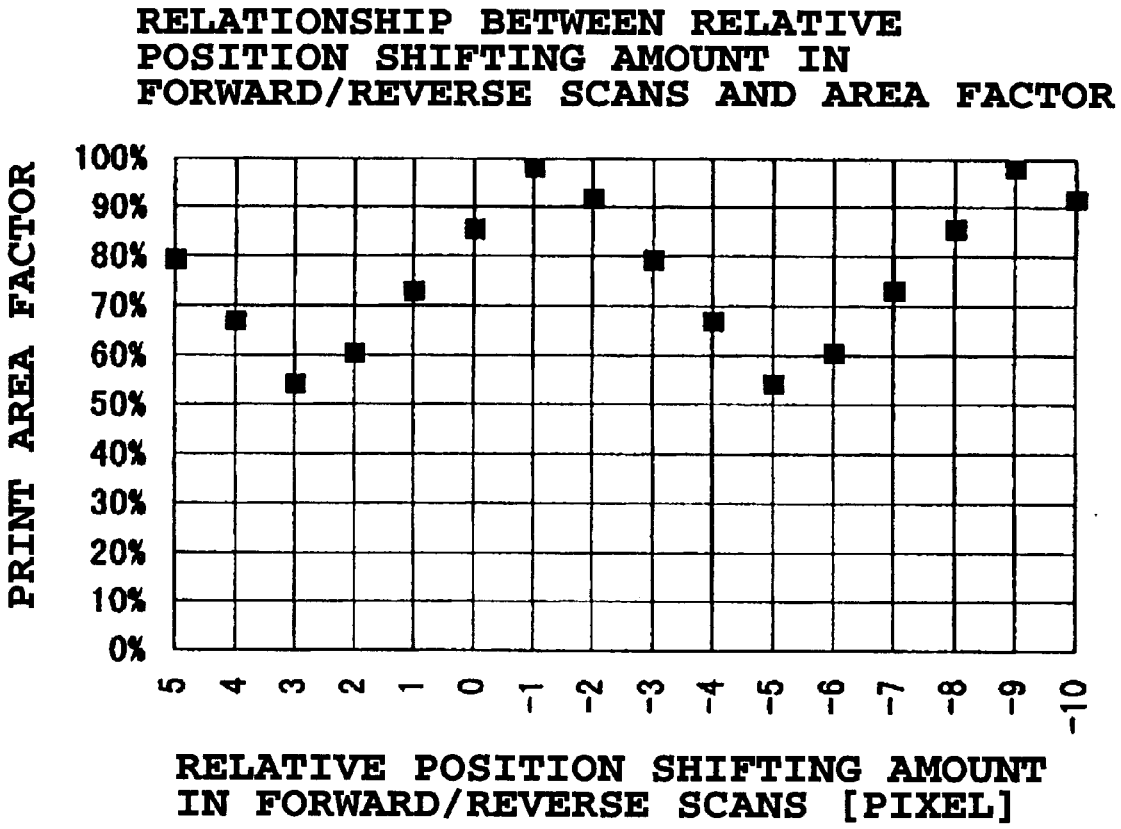
FIG. 21 is a graph showing relationship between shifting amounts of sample patches shown in FIG. 19 and print area factors.

As it is evident from the patterns (a) to (i) shown in FIGS. 15A to 15C, FIGS. 16A to 16C and FIGS. 17A to 17C, the print area factor of the sample patches SP1 to SP8 is cyclical, and it would be easily understood that a patch presenting a print area factor, as shown in FIG. 19, composed of forward scanning patch elements and, of reverse scanning patch elements formed by relatively offset by a pixel to the forward scanning patch elements, respectively, presents a cyclical area factor relation as shown in FIG. 20. On the other hand, the relationship between the relative position offset or shift amount between the forward and reverse printing scans and the area factor will be as shown in FIG. 21.

Figure 22:
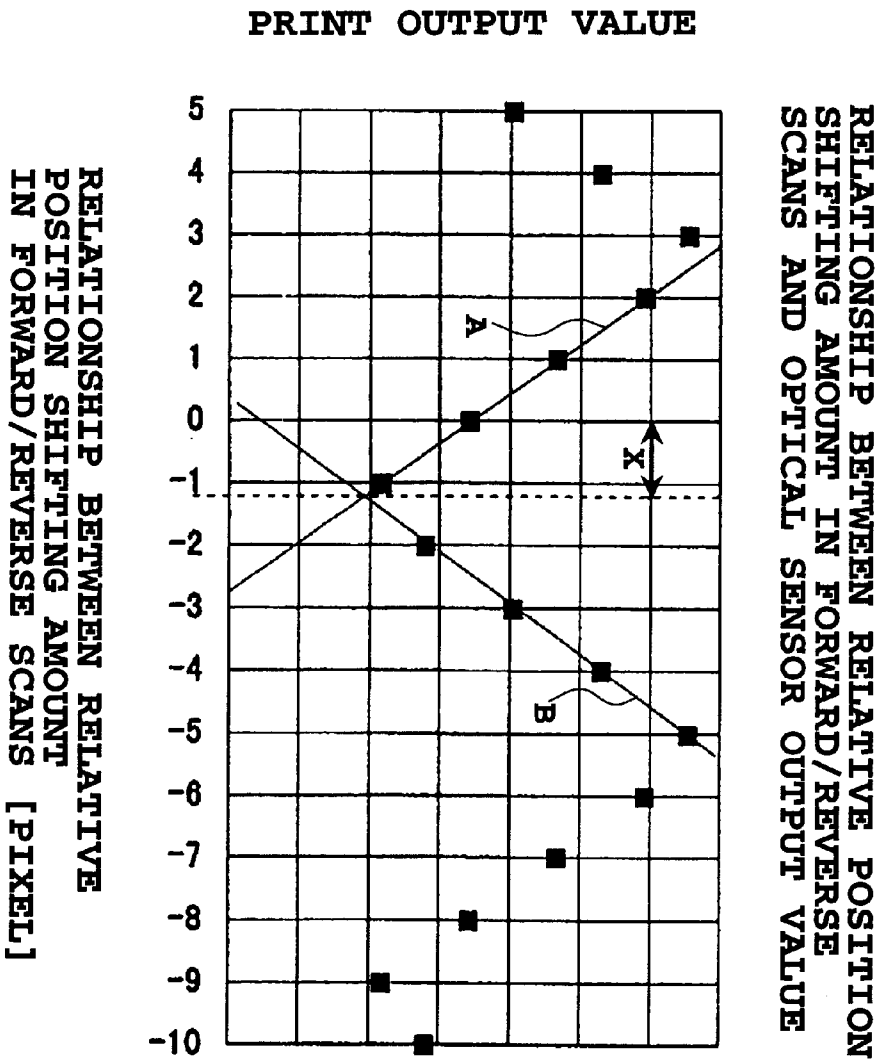
FIG. 22 is a graph showing relationship between shifting amounts of the sample patches shown in FIG. 19 and output values of an optical sensor for measuring the sample patches, and describes a processing to determine a function for obtaining an adjustment amount of a dot alignment.

As the output value of the optical sensor represents the reflected light intensity, the relationship between the offset or shift amount between the forward and reverse printing scans and said output value will be as shown in FIG. 22. Note that, in FIG. 22, the vertical line corresponds to the reflected light intensity, while the horizontal line to the printing position shifting amount (by dot).

Now, in the relationship shown in FIG. 22, first a straight line A is determined by means of the output values from the sample patches SP4, SP5 and SP6, and a straight line B by means of sample patches SP8, SP1 and SP2. Next, the intersection point of the straight line A and the straight line B is determined, allowing to calculate a relative offset amount caused between the forward and reverse printings. Namely, this allows to determine the relationship between the print position offset amount between the forward and reverse printings and the output value of the optical sensor 30.

Therefore, if the relationship between a dot formation position shifting amount X between the forward and reverse printings and an output value D of the optical sensor 30 in FIG. 22 can be represented by a following function F:

$$D=F(X+a)$$

the relationship between the entire print position offset amount x (=X+a) and the output value D of the optical sensor 30 will be:

$$D=F(x)$$

provided that x is within the range of $-4<x<4$.

Particularly, within the range of $0<x<4$, as D and x are in one-to-one relation, an inverse function G of the function F can be obtained easily. In other words, it will be:

$$x=G(D)$$

These operations constitute the processing of the step S1004 in FIG. 13.

Next, for example, the optimal adjustment value will be determined for each mode (normal mode, rapid printing mode, high resolution printing mode or the like) of a printing apparatus.

First, the carriage speed corresponding to one mode (for example, a normal mode) is set, then a patch element of repetition of a dot-forming area for 4 dots and a blank area for 4 dots to the right in the forward direction, and a patch element of repetition of a dot-forming area for 4 dots and a blank area for 4 dots from right second pixel from the leftmost pixel column of the absolute position reference of the concerned patch element to the right in the reverse scan are formed respectively, to obtain a single patch PM (step S1006).

Next, the density is measured for this patch (step S1007), before obtaining the relative adjustment value between the forward and reverse printings using the aforementioned function (step S1008).

Figure 23:
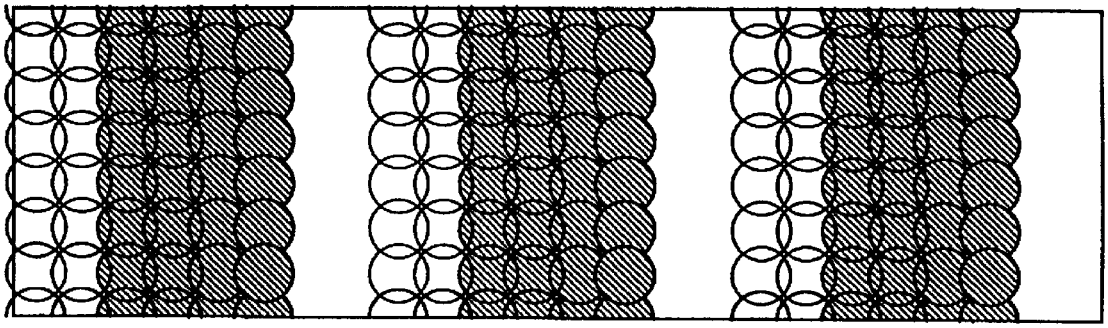
FIG. 23 shows a print pattern in which no relative offset is caused on dot formation position between the first and second printings.
Figure 24:
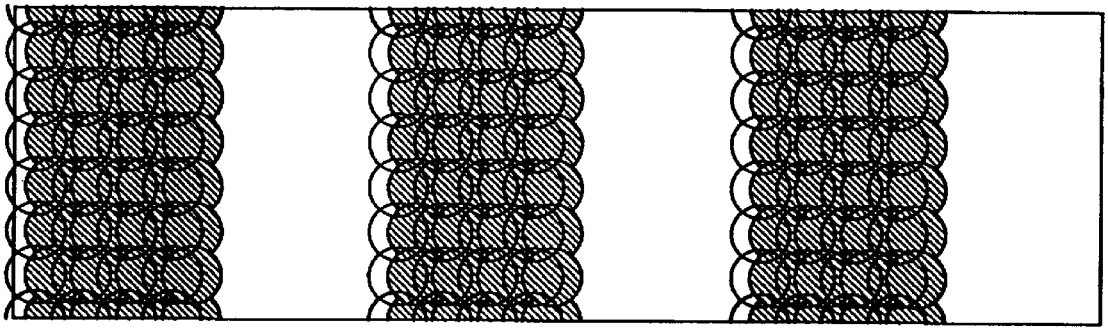
FIG. 24 shows a print pattern in which relative offset is caused on dot formation position between the first and second printings.
Figure 25:
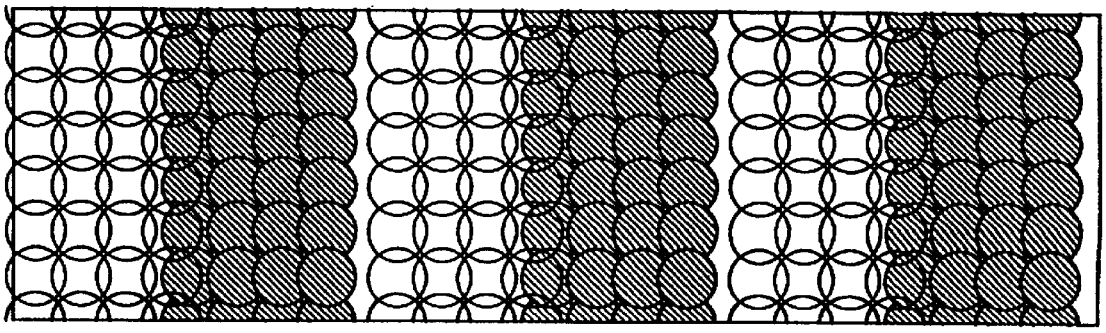
FIG. 25 shows a print pattern in which relative offset occurs on dot formation position in the direction opposite to that indicated in FIG. 24 between a first and a second printings.
Figure 26:
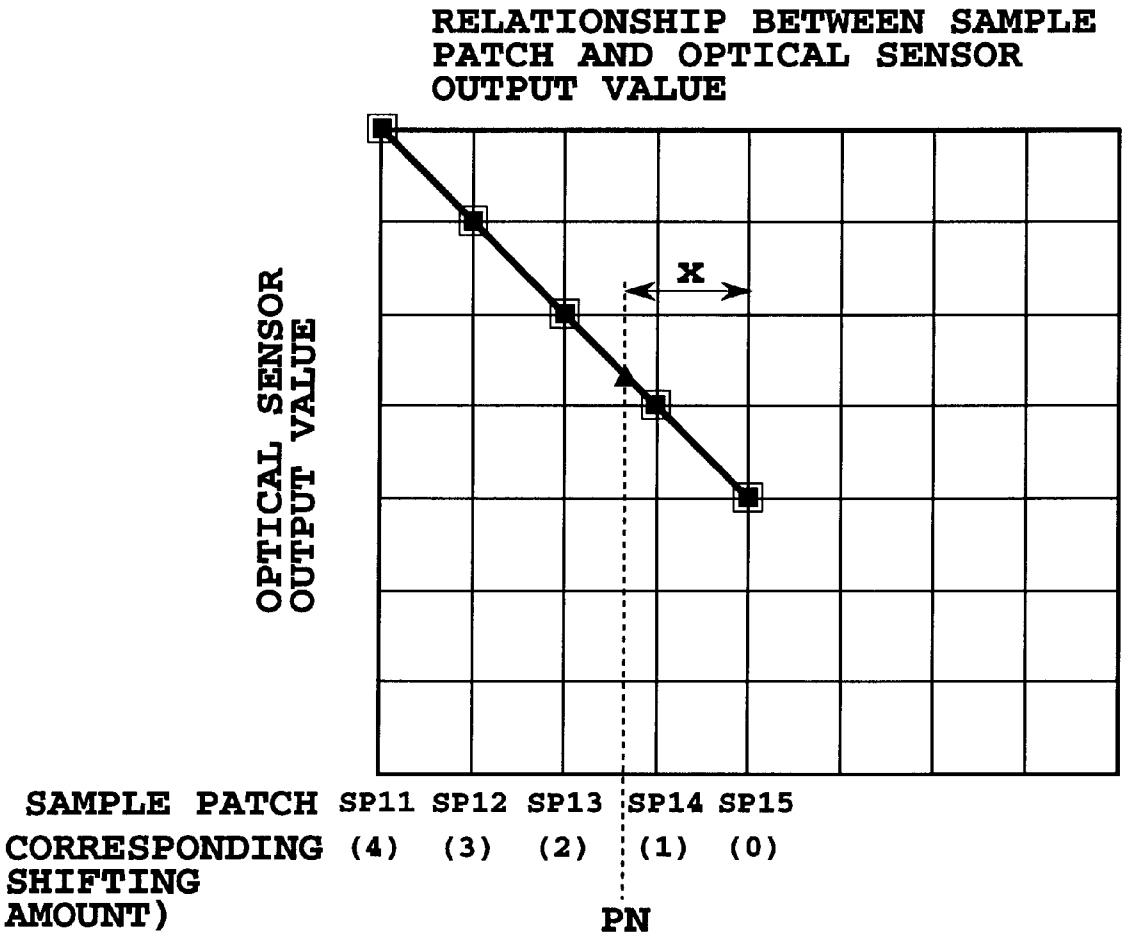
FIG. 26 is a graph for describing another embodiment of a dot alignment processing.

In this case, supposing that the tolerance of the relative offset amount occurred between the forward and reverse printings be ü}1.5 pixel, a patch as shown in FIG. 23 will be formed if the relative offset amount between the forward and reverse printings is null, a patch as shown in FIG. 24 if the relative offset amount caused between the forward and reverse printings is for example +1.5 pixel, and a patch as shown in FIG. 25 if the relative offset amount caused between the forward and reverse printings is for example −1.5.

Therefore, the relative offset amount produced between the forward and reverse printings with one carriage speed, namely the relative adjustment value, can be obtained by measuring the density of thus formed patch, and by applying the aforementioned function G.

Next, the processing of the steps S1005 to S1008 will be performed for each carriage speed corresponding to other modes of the printing apparatus, to form patches (for example, patch PF corresponding to the rapid printing mode, patch PS corresponding to the high resolution printing mode) at respective speeds and to obtain the relative adjustment value (step S1009). When the processing is completed for all of speeds, the printing medium 8 is discharged (step S1010), before exiting from the procedures of FIG. 13 (step S1011).

Note that the dot alignment for the bi-directional printing, namely the adjustment of the relative ink deposition position accuracy of the forward scanning printing and the reverse scanning printing will be performed by adjusting the driving timing in respective scanning. Here, such adjustment may be performed only for Bk or also for other colors. That is, a processing corresponding to the colors used in the bi-directional printing may be performed.

Moreover, in the case mentioned above, for example, a red LED may be adopted as light-emitting section in the optical sensor 30 for Bk or C color inks presenting enough absorption characteristics to the red light. Moreover, LEDs may be selected according to the color to be adjusted or the pattern forming color. For example, dot alignment may be performed for each color (C, M, Y) by providing a blue LED, a green LED or the like, other than red. On the other hand, as it is preferable to perform the printing registration for all colors if each color ejecting portion (head) is composed separately and used side by side with a printing apparatus, sensors responding to this may be prepared and the adjustment may be performed responding respectively.

Moreover, in this example, basically respective straight lines passing the data both sides of the point where the reflected light intensity is maximum have been obtained by means, for example, of the method of least squares, and then the intersection point of these straight lines has been determined to obtain a function. However, other than the determination of the print position agreement point or the function by such the approximation using straight lines, it may also be determined by approximation using curved lines.

Additionally, in this example, the reflected light intensity detected by the optical sensor 30 is used as optical characteristics, however, an optical reflection index, a reflection optical density or a transmission optical density or the like may well be used.

By the way, using the incident light Iin 35 and the reflection light Iref 37 shown in FIG. 7, a reflection index R=Iref/Iin and a transmission index T=1−R. Incidentally, an optical density may be defined as the reflection optical density using the reflection index R or a transmission optical density using a transmission index T. Assuming that d represents a reflection optical density, R=10−d. Namely, as for patterns of FIGS. 15A to 15C, FIGS. 16A to 16C and FIGS. 17A to 17C, the reflection index R becomes minimum for the pattern (e) i.e., the reflection optical density d becomes maximum. So the reflection optical density d decreases as the printing position of the reverse scanning patch element offsets relatively to any of the plus and minus directions.

Moreover, since the optical characteristics are measured in the state in which the carriage 2 is stopped, the influence of noise caused by the driving of the carriage 2 can be avoided. A distance between the sensor 30 and the printing medium 8 is increased to widen a measurement spot of the optical sensor 30 more than the dot diameter, thereby averaging variations in local optical characteristics (for example, reflected light intensity) on the printed pattern so as to achieve highly precise measurement.

In order to relatively widen the measurement spot of the optical sensor 30, it is desired that a sensor having a resolution lower than a printing resolution of the pattern, namely, a sensor having a measurement spot diameter greater than the dot diameter be used. Furthermore, from the viewpoint of determination of an average density, it is also possible to scan a plurality of points on the patch by means of a sensor having a relatively high resolution, i.e., a small measurement spot diameter and to take an average of the thus measured densities as the measured density.

In order to avoid any influence of fluctuations in measurement, it may be possible to measure the reflection optical density of the same patch a plurality of times and to take an average value of the measured densities as the measured density.

In order to avoid any influence of fluctuations in measurement due to the density variations on the patch, it may be possible to measure a plurality of points on the patch to average or perform other operations on them. Measurement can be achieved while the carriage 2 is moved for time saving. In this case, in order to avoid any fluctuation in measurement due to electric noise caused by the driving of the motor, it is strongly desired to increase the times of samplings and average or perform other operations.

Though in the aforementioned embodiment, the processing has been made for three modes of different carriage speed, namely the normal mode, the rapid print mode and the high resolution pint mode, the processing may well also be performed corresponding to respective mode, if a printing apparatus provides modes of different carriage speed. Moreover, the present invention may also be applied to obtain the registration conditions of respective mode, even for a plurality of mode not necessarily provided with such carriage speed modification (such as printing modes realized by changing the conditions of print resolution or print dot size), if the obtained function is not inconvenient.

There, such adjustment processing may well be applied to all modes provided by a printing apparatus, or only to certain modes designated according to the selection by the user or others. In such a case, for example, the processing for forming the sample patches SP1 to SP8 and determining the above function may be separately performed, and such the function may be held for executing a measurement corresponding to a mode or an adjustment value determination processing as necessary.

Additionally, the speed to be set for forming the sample patches SP1 to SP8 may be selected from one of the above modes, or other speeds may also be set. In this case, for example, if the formation is performed with a carriage speed higher than the rapid printing mode, as much reduction of dot alignment processing time or other effects can be expected.

Also, an activation of the adjustment processing is performed by operations of a start switch, etc. provided in the body of printer, and indication through application of the host device 110, and additionally, for example, taking into consideration a temporal change of each section of the printing apparatus and the head, in the case where the adjustment has not been performed for a long-termed period, an adjustment processing can also be activated or urged using controlling means such as a timer. Moreover, even in the case where a head cartridge 1000 is exchanged, the adjustment processing can be activated or urged.

4. Second embodiment of dot alignment processing

In the aforementioned first embodiment, the sample patches SP1 to SP8 for determining the relationship between the relative offset between the forward printing and the reverse printing and the output of the density sensor (optical sensor 30) are printed by forming patch elements respectively in the forward and reverse scans. On the other hand, in this embodiment, the following sample patches are printed in any one of forward and reverse scans.

In other words, in this example,

SP11: a patch in which a dot-forming area for 8 dots and a blank area for 0 dot appear alternately and repeatedly within a predetermined width from the leftmost pixel column of the patch absolute position reference to the right, SP12: a patch in which a dot-forming area for 7 dots and a blank area for 1 dot appear alternately and repeatedly within the predetermined width from the leftmost pixel column of the patch absolute position reference to the right, SP13: a patch in which a dot-forming area for 6 dots and a blank area for 2 dots appear alternately and repeatedly within the predetermined width from the leftmost pixel column of the patch absolute position reference to the right, SP14: a patch in which a dot-forming area for 5 dots and a blank area for 3 dots appear alternately and repeatedly within the predetermined width from the leftmost pixel column of the patch absolute position reference to the right, and SP15: a patch in which a dot-forming area for 4 dots and a blank area for 4 dots appear alternately and repeatedly within the predetermined width from the leftmost pixel column of the patch absolute position reference to the right, are formed in the forward (or reverse) scan. As the result, the patches SP11 to SP15 will be equivalent, respectively, to (a) to (e) among patterns (a) to (i) described in FIGS. 15A to 15C, FIGS. 16A to 16C and FIGS. 17A to 17C.

FIG, 26 shows the measurement results of these patches, that allows to obtain easily the function F and the inverse function G as in the aforementioned first embodiment. Thereafter, as the similar manner in the above embodiment, a patch formation and a measurement will be performed according to each speeds, and the measured value will be applied to the aforementioned function to obtain the adjustment value. Namely, for example, a patch is formed by overlay printing of a patch element composed of repetition of a dot-forming area for 4 dots and a blank area for 4 dots to the right formed in the forward direction and a patch element composed of repetition of a dot-forming area for 4 dots and a blank area for 4 dots within a predetermined width from the second pixel from the leftmost pixel column of the patch absolute position reference to the right formed in the reverse scan, and then a measurement of the patch is performed. Here, if a patch PM is obtained for a carriage speed in the normal mode, the adjustment value can be obtained from the relation with the corresponding shifting amount, by applying its reflected light intensity to the above function.

This embodiment allows to reduce further the adjustment time, and also to calculate easily the relationship between the relative printing offset amount and the density.

It is evident that the modification similar to the aforementioned first embodiment can be applied.

5. Dot Alignment Among a Plurality of Heads

Though the relative offset amount or the adjustment amount between the forward and reverse direction printings for a same head (ejecting portion) were determined in two embodiments mentioned above, an execution range of the dot alignment can be defined as required corresponding to the printing modes, the construction or the like of the apparatus. For example, in the printing apparatus using a plurality of print heads(ejecting portions) as shown in FIG. 5, the dot alignments of bi-directional printing and printing by the plurality of heads in the main scanning direction are carried out, and in the printing apparatus using only one head, the dot alignment of bi-directional printing have only to be carried out. Moreover, even in the case of one head, when it is possible to eject the ink of a different color tone (a color and/or a density) or when the different amount of ejection can be obtained, for every each color tone or each amount of ejection, the dot alignment may be carried out.

In the dot alignment processing among a plurality of heads, for example for two heads, the patch elements that were formed for the forward and reverse scans in the aforementioned embodiments are formed for the respective heads, and the density measurement will be performed for patches printed by them to obtain the above function and adjustment value. This example of the relationship between two head can also be applied to the relationship among three or more heads. For example, if there are three heads, the printing positions are registered between the first head and the second head, and then the printing positions of the first head and the third head have only to be registered.

The apparatus according to this embodiment uses a head arranging in parallel a Black ink ejection portion arraying a nozzle group for ejecting ink of black as shown in FIG. 6A and each color ink ejection portion arraying a nozzle group for ejecting each ink of Y, M and C integrally and in an inline manner in response to a range of arraying the ejection openings of Black. Accordingly, in particular, if the printing registration between Black and, for example, C is performed when the vertical dot alignment processing between a plurality of heads (ejecting portions) is performed, nozzle groups of M and Y inks which are manufactured integrally and in an inline manner in the same processing as an ejection opening group of a C ink is substantially performed printing registration with respect to the Black ejection portion, and namely, the dot alignment processing between the plurality of heads (ejecting portions) is completed.

Accordingly, in particular, a red LED is adopted as a the light emitting section when the dot alignment processing between the plurality of heads (ejecting portions) is carried out, while it is enough if Black and C inks having sufficient absorption characteristics for a red light are used to form a measuring patch so that the printing registration is carried out.

However, it is possible to correspond to each color by deciding a color used for the dot alignment in response to characteristics of LED used. Conversely, the LED can be selected in response to a color forming a pattern. For example, a blue LED, a green LED, etc. in addition to a red LED may be mounted, whereby the dot alignment can be carried out for Black in each of color ejecting portions (heads). Moreover, in the case where each color ejecting portion (head) is separately constituted and arranged in parallel with each other in the main scanning direction in the printing apparatus, it is preferable that the printing registration is performed in every color. Therefore, a sensor corresponding thereto is prepared and an adjustment is carried out as required.

A similar adjustment may be applied not only to the main scanning direction, but also to the subscanning direction (vertical or auxiliary scanning direction). For example, the printing position can be corrected by the unit of ejecting outlet interval, by adopting a composition wherein ink ejecting outlets of respective print head (ejecting portion) are disposed over a range larger than the maximum width (band width) in the auxiliary scanning direction of an image formed by one scan, and the range of ejecting outlets to be used are shifted in use. Namely, as a result of shifted correspondence between the data (image data or the like) to be output and the ink ejecting openings, it becomes possible to shift the output data per se. However, the vertical direction adjustment is not limited by the adjustment of such the image data forming positions. As the vertical printing position registration accuracy depends on the printing head resolution and the control resolution of printing medium in the feeding direction, the adjustment may well be performed by using them if they are sufficient.

Moreover, in this embodiment, in the lateral dot alignment, not only an adjustment in the forward scan printing between the respective heads is performed, but also an adjustment in the reverse scan printing may be performed. This is because that in the case where the dot alignment of the bi-directional printing is adjusted by the single head, even if the adjustment value is used by the other print heads, a depositing position offset occasionally occurs. That is, when an ejecting direction of an ink is different in each printing head or an ejection speed is different, a state of the bi-directional printing is different in each printing head. This is the reason. In such the phenomenon, in the case where only one of adjustment values of the bi-directional printing can be set, the dot alignment is executed by a single print head which the bi-directional printing references. Next, by use of the print head which the bi-directional printing references as a reference even in a lateral direction, the lateral dot alignment is carried out in each of the scan prints. Thereby, it is possible to suppress a generation of offsets of the bi-directional or lateral depositing position caused by the characteristics of the print head.

Moreover, in the case where a plurality of adjustment values of the bi-directional printing can be set, the dot alignment of the bi-directional printing is carried out in each of the print heads, and the lateral dot alignment is carried out only in a single direction, thereby to adjust the depositing position even when the characteristics of each print head are different.

Moreover, at a time of a dot alignment processing or at a time of actual printing operations using the results, the following can be applied for offsetting the depositing position:

In the bi-directional printing, the ejection start position is controlled using an interval equal to a generation interval of a trigger signal of a carriage motor 6, for example. In this case, an interval of 80 nsec (nanoseconds) can be set by a software for the gate array 140, for example. However, only a required resolution is enough and about 2880 dpi (8.8 mm) is sufficient precision.

Concerning a lateral direction of a printing using a plurality of heads, the image data are controlled at an interval of 720 dpi. The offset within one pixel is controlled by changing 720 dpi driving block selecting order between the plurality of heads in a form in which a nozzle group is divided into several blocks and driven in time-sharing, and further the offset of one pixel or more is controlled by offsetting the image data to be printed between the plurality of heads.

Concerning a vertical direction of a printing using the plurality of heads, the image data are controlled at an interval of 360 dpi and the image data to be printed are controlled by offsetting between the plurality of heads.

6. Patch Pattern

Though discrete square or rectangular patterns (patches) is formed for each of the sample patch as shown in FIG. 14, and patches for respective speeds are formed at different positions in the sub-scanning or auxiliary direction in the aforementioned first embodiment, the invention is not limited to the above embodiment. Moreover, the number of sample patches may be determined appropriately.

It will be sufficient that the density measurement corresponding to respective formation conditions is performed and the function is determined. Further, for example, a plurality of sample patches SP1 to SP8 in FIG. 14 or SP1 to SP15 may be connected to each other. With such pattern, an area for the printing patterns or patches can be reduced.

However, in the case where such pattern is printed on the printing medium 8 by the ink-jet printing apparatus, the printing medium 8 is expanded and a cockling is caused depending upon the kind of printing medium 8 if the ink is ejected to an area in excess of a predetermined quantity, to possibly deteriorate the precision of deposition of the ink droplets ejected from the printing head. The formation of sample batches as shown in FIG. 14 has an advantage of preventing such phenomenon as much as possible.

On the other hand, by changing the carriage movement speed in one main scanning, patches PM, PF and PS may be formed by such the one main scanning to juxtapose at the same position in the sub-scanning direction. In this case, as for the density measurement, a main scanning may be performed again after the main scanning for forming all of these patches, or it may also be composed to complete them by a single main scanning.

Also, as for the sample patches SP1 to SP8, though the example in which each pattern is formed by overlaying, shifting by one dot, a patch element composed of repetition of a dot-forming area for 4 dots and a blank area for 4 dots formed in the forward scan and a patch element composed of repetition of a dot-forming area for 4 dots and a blank area for 4 dots formed in the reverse scan, is described in the aforementioned first embodiment, a unit can be set appropriately for the dot formation area, the blank area and the shifting amount, according to the registration (print positioning) accuracy or the optical intensity (or density) detection accuracy or the like.

What is intended by this pattern is that the area factor is reduced with respect to an increase in mutual shifting of the printing positions in the forward scan and the reverse scan. This is because the density of the optical characteristics of the patch is significantly dependent on variations of the area factor. Namely, although the dots are overlapped with each other so as to increase the density, an increase in not-printed region has a greater influence on the average density of the overall patch.

Both of print patterns in the forward scanning and the reverse scanning are not required to be juxtaposed one by one row vertically.

Figure 27A:
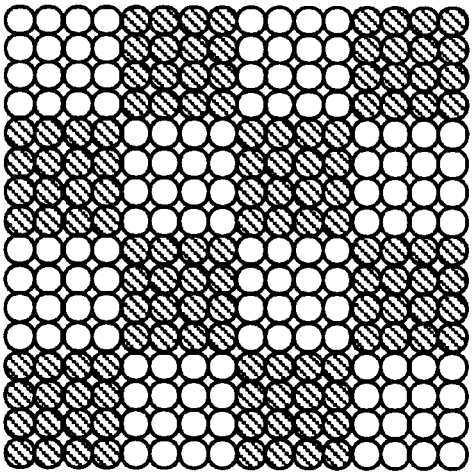
FIGS. 27A and 27B are schematic views showing further examples of patterns usable in a dot alignment processing according to the invention.
Figure 27B:
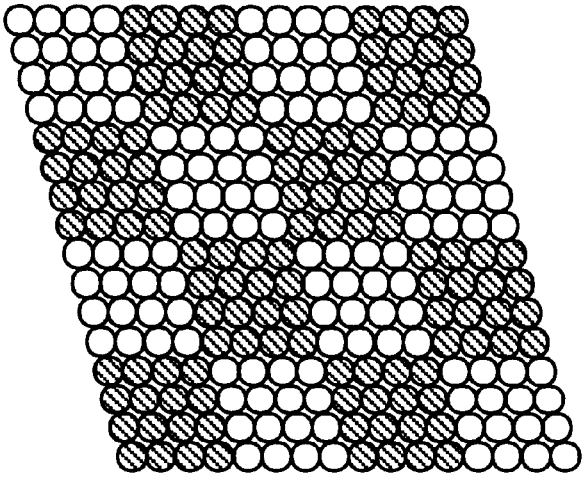

FIG. 27(A) shows a print pattern where dots printed in the forward scanning and dots printed in the reverse scanning interlace mutually, while FIG. (B) shows a print pattern where dots are formed aslant. The present invention may also be applied to such patterns. Moreover, if the density of the dots themselves formed on the printing medium 8 is so high that it prevents the optical sensor 30 to measure with a high accuracy the optical characteristics according to the dot shifting amount event if the aforementioned sample patches are printed, it is effective to apply a predetermined thinning-out to each dot row. On the contrary, if the print density is too low, dots may be formed by double printing at the same position, or a double printing may be applied to a certain portion.

7. Examples of Additional Processing to the Dot Alignment Sequence

In the processing procedures of FIG. 13, any additional processing as mentioned below may be added as necessary to the dot alignment processing in the bi-directional printing for the other colors mentioned above, or the dot alignment processing among two or more heads in the main scanning direction and/or the sub-scanning direction among a plurality of heads (ejecting portions).

(7.1) Recovering processing

This consists in a sequence of recovering operations such as suction, wiping, preliminary ejection or the like, for improving the print head ink ejection state or maintaining its good state, before performing an automatic dot alignment.

Concerning the operation timing, the recovering operation is performed prior to the execution in the case where an execution instruction of the automatic dot alignment is made. This allows to print the patterns for the printing registration with the printing head in a stable ejection state and, therefore, to set correction conditions for a more reliable printing registration.

The recovering operations are not limited to a series of operations such as sucking, wiping, preliminary ejecting and the like, but may be only preliminary ejecting or only preliminary ejecting and wiping. It is preferable that the preliminary ejecting in this case is set so as to perform preliminary ejecting having the greater number of ejection than that at a time of printing. Further, in a combination of the number of times of sucking, wiping, preliminary ejecting and order of operations, there are in particular no conditions for limitation.

Further, it may be decided whether execution of sucking recovery prior to automatic dot alignment control is required in response to an elapsed time from sucking recovery at a previous time or not. In this case, it is first decided whether a specified period of time elapses from previous sucking operations immediately before the automatic dot alignment is carried out or not. If the sucking operations are executed within a specified period of time, the automatic dot alignment is executed. In the meantime, if the sucking recovering operations are not executed within the specified period of time, after a series of recovering operations containing the sucking recovery are executed, the automatic dot alignment can be carried out.

Further, it is decided whether the print head ejects an ink at the specified number of ejection or more from the previous sucking recovery or not, and in the case where the ink is ejected at the specified number of ejection or more, after the recovery operations are executed, the automatic dot alignment may be executed. Further, by use of both the elapsed period of time and the number of ink ejection as decision materials, a combination may be made so that, if any one reaches a specified value, the sucking recover is executed.

Thus, as it is possible to prevent the sucking recovery from being excessively executed, this can contribute to saving of a consumption amount of inks and a reduction of an ink discharge amount to a disused ink processing portion, and also the recovering operations prior to the automatic dot alignment can effectively be carried out.

Further, recovery conditions are variable in response to the elapsed time from the previous sucking recovery or the number of ink ejection, and for example, in the case where the elapsed period of time is short, only preliminary ejection and wiping are carried out without executing the sucking operations, and in the case where the elapsed period of time is long, the recovery conditions may be changed, for example, the sucking recovery is midway executed.

Though the recovery operation may be performed as mentioned above, but a structure for executing the recovery operations is not always required to use, and if the printing apparatus is originally high in reliability, the recovering operations in the automatic dot alignment processing are not required to execute. It is more preferable that high reliability is secured and besides the automatic dot alignment processing is executed.

(7.2) Sensor calibration

That is, lights are irradiated from the light-emitting side of the optical sensor 30 on a patch, and in order to decide the optimum printing registration conditions from relative values of the reflected lights output, unless the optimum light amount is irradiated and an optimum electric signal is applied to a photosensing side, a reliable output difference cannot be obtained. In order to obtain a sufficient output difference (an output difference between patterns when printing positions are changed at a minimum in actual printing registration patterns), it is strongly desirable that a calibration of a sensor itself (a light-emitting portion side and/or a photosensing portion side) is performed. This is preferable when correcting variations peculiar to a density sensor (an optical sensor), a sensor mounting tolerance in the printing apparatus, an atmosphere difference such as a state of lights, humidity, an air of an environment (mist, smoke), a temporal change of a sensor itself, influences of an output reduction due to heat storage, mist adhered to the sensor, influences of an output reduction due to paper powders, or the like.

Therefore, in one example of a calibration, the light-emitting portion (LED or the like) disposed in the optical sensor 30 is calibrated to obtain a predetermined range as output characteristics of the optical sensor, preferably so that it may be used in the linear area, for instance, by PWM-controlling a supplying electric power. Specifically, the supply current is PWM-controlled, and a current amount flowing at intervals of 5% is controlled, for example, from a full power of 100% duty to a power of 5% duty, thereby to obtain an optimum current duty, so that LED of the optical sensor 30 is driven as an example.

Now, the calibration of this light emitting section side will be described briefly. Suppose the maximum rated value of the electric signal to be applied to the light-emitting side be 100%, the output characteristics are measured by sequentially changing the electric signals from 0% to 100% by the minimum unit of light emitting amount variation, in response to the predetermined image patterns designed for the calibration with different reflectivity or reflectance. If a light amount is too weak, an amount of reflected lights is too small between outputs of patterns of different reflectivity and a difference in output is scant. On the contrary, if a luminous amount is too strong, reflected lights are increased in a pattern of reflectivity inclining toward a white ground in outputting patterns of different reflectivity, and at a time of exceeding detection capability on a side of light reception, there is scarcely a difference from an output of a white ground. Therefore, if such pattern in a reflectivity area exists in actual printing registration patterns, an output difference cannot preferably be obtained. Here, it is material that the output difference in the reflectivity area of the pattern used for the printing registration can be obtained. Here, a driving current whose good S/N ratio is secured will be selected, considering that enough output difference can be obtained in the reflectivity area of patterns to be used for the printing registration.

A modulation of a driving signal on the light-emitting side is made in a processing of the MPU 101 inside a printer and the modulation unit amount can be processed in minimum unit which a luminous amount is changed.

The modulation is same in a calibration on a photosensing side, and the optimum electric signal applying conditions can be decided when reflectivity of patterns for printing registration are measured by the above method. The modulation of a driving signal of the photosensing side is performed by a processing of the MPU 101 inside the printer and the modulation unit amount can be processed in minimum unit which a luminous amount is changed.

Next, the object to be measured used for sensor calibration (calibration pattern) is composed of colors that react sensitively to the sensor light emitting wavelength or frequency. It may be monochromatic, or a combination of a plurality of colors provided that the reflectivity does not change according to the position in a predetermined area.

Moreover, in the case where the sensor calibration pattern changing reflectivity is used, the pattern may be a pattern which each pattern becomes is an independent patch, and partial patterns changing reflectivity may be continued.

Also, in the sensor calibration, the electric signal may be roughly changed for the coarse adjustment and then slightly for the fine adjustment, or it may well be changed delicately from the beginning.

Further, in the sensor calibration, while an electric signal to be applied is changed in a processing of a main scan of the carriage, a measurement may be executed, or after the carriage is stopped and it is changed, a measurement may be executed. Furthermore, the calibration may be executed within one scan or within a plurality of scans.

(7.3) About confirmation pattern

After the dot alignment execution, a confirmation pattern may be printed, with the set deposition position conditions, in order to confirm the exactitude of its control, or to permit the user to recognize the results of the dot alignment. Normally, as ruled lines are easy to recognize, rules lines are printed in respective modes such as bi-directional printing, among a plurality of heads, or other, and for respective printing speed. This allows the user to recognize at a glance the results of the dot alignment that has been executed.

(7.4) About manual adjustment

In the embodiment, the automatic dot alignment processing is designed to perform after performing detection of density using the optical sensor. However, another dot alignment processing also is made possible in preparation for the case or the like where the optical sensor does not operate desirably. Namely, in this case, a usual manual adjustment is performed. The condition which shifts to such manual adjustment is described.

First, the calibration can be performed before using the optical sensor; and if thus obtained data are obviously out of the usable range, it will constitute a calibration error and the dot alignment operation shall be suspended. The status of this situation is communicated to the host computer 110 and an error will be displayed through an application. Further, the manual adjustment will be displayed to be executed to prompt its execution. Otherwise, when the calibration error is detected, the dot alignment operation may be suspended, and the execution of manual adjustment may be prompted by printing on the printing medium being fed.

However, if a sensor error is temporary as is the accidental disturbance light from the exterior, the dot alignment processing can be resumed, after a certain time, or after sending a message to the user to arrange the conditions. If an error occurs during the execution of various printing registration processing correspond to the mode or others, the concerned processing may be suspended, to perform another printing registration processing.

8. Others

In each of the above embodiments, an example of an ink jet printing apparatus in which the ink is ejected from its print head on a printing medium to form an image has been shown. However, the present invention is not limited to this configuration. The present invention is also applicable to a printing apparatus of any type which performs printing by moving its print head and a printing medium relatively and to form dots.

However, in the case that an ink jet printing method is applied, the present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30 üÄ–70 üÄ so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Additionally, in the above embodiments, the processing of printing registration is carried out in the side of the printing apparatus. The processing may be carried out in the side of a host computer or the like, appropriately. That is, though a printer driver installed in the host computer 110 shown in FIG. 9 is designed to supply image data made to the printing apparatus, in addition to this, the printer driver may be designed to make test patterns (printing patterns) for printing registration and to supply them to the printing apparatus, and further designed to receive values read from the test patterns by an optical sensor on the printing apparatus for calculating adjustment amount.

Further, program codes of software or the printer driver for realizing the foregoing functions in the embodiments are supplied to a computer within the machine or the system connected to various devices including the printing apparatus in order to operate various devices for realizing the function of the foregoing embodiment, and the various devices are operated by the programs stored in the computer in the system or machine, is encompassed within the scope of the present invention.

Also, in this case, the program codes of the software per se performs the functions of the foregoing embodiment. Therefore, the program codes per se, and means for supplying the program codes to the computer, such as a storage medium, are encompassed within the scope of the present invention.

As the storage medium storing the program codes, a floppy disk, a hard disk, an optical disk, a CD-ROM, a CD-R, a magnetic tape, a non-volatile memory card, ROM and the like may be used, for example.

In addition, the function of the foregoing embodiments is realized not only by executing the program codes supplied to the computer but also by cooperatively executing the program codes together with an OS (operating system) active in the computer or other application software. Such system is also encompassed within the scope of the present invention.

Furthermore, a system, in which the supplied program codes are one stored in a function expanding board of the computer or a memory provided in a function expanding unit connected to the computer, and then a part of or all of processes are executed by the CPU or the like provided in the function expanding board or the function expanding unit on the basis of the command from the program code, is also encompassed within the scope of the present invention.

According to the invention, an optimal value for the adjustment of the depositing position of the printing dots can be obtained in the first and second printing of each of the forward scan and the reverse scan which the mutual dot-formed positions should be adjusted or the first and second printing of each of a plurality of the print heads. Therefore, a printing method and a printing apparatus can be provided in that the bi-directional printing or printing using a plurality of print heads is performed without the offset in depositing positions.

In addition, an apparatus or system which can printing a high-quality image at high speed can be achieved at low cost without problems about the formation of an image or operation.

Further, is allows to perform simply and rapidly an appropriate dot alignment in accordance with respective modes provided by a printing apparatus, such as a rapid printing or a high resolution printing.

The present invention has been described in detail with respect to preferred embodiments, and it will now be apparent from the foregoing to those skilled in the art that changes and modifications may be made without departing from the invention in its broader aspect, and it is the invention, therefore, in the apparent claims to cover all such changes to cover all such changes and modifications as fall within the true spirit of the invention.

What is claimed is:

1. A printing registration method for performing printing registration in a first printing and a second printing with respect to a printing apparatus which performs printing of an image on a printing medium by said first printing and said second printing with predetermined conditions of a dot forming position by using a printing head, said method comprising:

a first pattern forming step of forming a plurality of patterns respectively having different area factor of dot formation area by said first and/or second printing using said print head;

a first measuring step of measuring respective optical characteristics of said plurality of patterns formed;

a function determining step of determining a function showing the relationship between the printing position offset between said first and second printings and the optical characteristics, on the basis of the measured optical characteristics;

a second pattern forming step of forming a pattern having a predetermined area factor of dot formation area by said first printing and second printing;

a second measuring step of measuring the optical characteristics of the pattern formed by said second pattern formation step; and an adjustment value acquiring step of acquiring an adjustment value of a dot forming position condition between said first printing and said second printing, by applying the optical characteristics measured by said second measuring step to said function.

2. A printing registration method as claimed in claim 1, wherein said first pattern forming step carries out an overlay printing of pattern elements where a dot formation area for a predetermined number of pixel and a blank area for a predetermined number of pixel are repeated, in such manner shifting by a predetermined amount for changing said area factor by said first printing and second printing, thereby forming said plurality of patterns.

3. A printing registration method as claimed in claim 1, wherein said first pattern forming step forms said plurality of patterns respectively having different area factor of said dot formation area, by either of said first printing and second printing.

4. A printing registration method as claimed in claim 1, further comprising a step of inducing said second pattern forming, said second measuring and said adjustment value acquiring, according to a plurality of modes which can be set for performing said printing.

5. A printing registration method as claimed in claim 4, wherein said plurality of modes are provided so as to correspond to a plurality of printing speeds.

6. A printing registration method as claimed in claim 1, wherein said first printing and said second printing include at least one among a printing in a forward scan and in a reverse scan upon performing printing by bi-directionally scanning said printing head with respect to said printing medium, a printing which is performed by a first printing head and a second printing head among a plurality of said printing heads, and is related to a direction in which said first and second printing heads are scanned relative to said printing medium, and a printing which is performed by said first printing head and said second printing head among a plurality of printing heads and is related to a direction different from the direction in which said first and second printing heads are scanned relative to said printing medium.

7. A printing registration method as claimed in claim 1, wherein the printing registration is performed with respect to the printing apparatus using a first printing head and a second printing head which are arranged in parallel in said scanning direction, said first printing head is provided with a plurality of printing elements for imparting printing agent to said printing medium at equally spaced to in-line in a direction different from said scanning direction in order to perform said first printing, and said second printing head is provided with a plurality of printing elements for imparting the printing agent to said printing medium at equally spaced to in-line in a direction different from said scanning direction in order to perform said second printing.

8. A printing registration method as claimed in claim 7, wherein the printing head for performing said first printing uses at least one printing agent, and the printing head for performing said second printing uses a plurality of printing agents of color tones among which at least one color tone is different from the color tone of said printing agent used by said first printing head.

9. A printing registration method as claimed in claim 1, wherein said printing head performs a printing by ejecting the inks.

10. A printing registration method as claimed in claim 9, wherein said printing head has heating elements for generating thermal energy which allows the inks from boiling, as an energy used for ejecting the inks.

11. A printing apparatus for performing an image printing on a printing medium by a first printing and a second printing with predetermined conditions of a dot forming position by using a printing head, comprising:

a first pattern forming means for forming a plurality of patterns respectively having different area factor of dot formation area by said first and/or second printing of said print head;

a first measuring means for measuring respective optical characteristics of said plurality of patterns formed;

a function determining means for determining a function showing the relationship between the printing position offset between said first and second printings and the optical characteristics, on the basis of the measured optical characteristics;

a second pattern forming means for forming a pattern having a predetermined area factor of dot formation area by said first printing and second printing;

a second measuring means for measuring the optical characteristics of the pattern formed by said second pattern forming means; and an adjustment value acquiring means for acquiring an adjustment value of a dot forming position condition between said first printing and said second printing, by applying the optical characteristics measured by said second measuring means to said function.

12. A printing apparatus as claimed in claim 11, wherein said first pattern forming means carries out an overlay printing of pattern elements where a dot formation area for a predetermined number of pixel and a blank area for a predetermined number of pixel are repeated, in such manner shifting by a predetermined amount for changing said area factor by said first printing and second printing, thereby forming said plurality of patterns.

13. A printing apparatus as claimed in claim 11, wherein said first pattern forming means forms said plurality of patterns respectively having different area factor of said dot formation area, by either of said first printing and second printing.

14. A printing apparatus as claimed in claim 11, further comprising means for inducing said second pattern forming, said second measuring and said adjustment value acquiring, according to a plurality of modes which can be set for performing said printing.

15. A printing apparatus as claimed in claim 14, wherein said plurality of modes are provided so as to correspond to a plurality of printing speeds.

16. A printing apparatus as claimed in claim 11, wherein said first printing and said second printing include at least one among a printing in a forward scan and in a reverse scan upon performing printing by bi-directionally scanning said printing head with respect to said printing medium, a printing which is performed by a first printing head and by a second printing head among a plurality of said printing heads, and is related to a direction in which said first and second printing heads are scanned relative to said printing medium, and a printing which is performed by by said first printing head and said second printing head among a plurality of printing heads and is related to a direction different from the direction in which said first and second printing heads are scanned relative to said printing medium.

17. A printing apparatus as claimed in claim 11, wherein the printing registration is performed with respect to the printing apparatus using a first printing head and a second printing head which are arranged in parallel in said scanning direction, said first printing head is provided with a plurality of printing elements for imparting printing agent to said printing medium at equally spaced to in-line in a direction different from said scanning direction in order to perform said first printing, and said second printing head is provided with a plurality of printing elements for imparting the printing agent to said printing medium at equally spaced to in-line in a direction different from said scanning direction in order to perform said second printing.

18. A printing apparatus as claimed in claim 17, wherein the printing head for performing said first printing uses at least one printing agent, and the printing head for performing said second printing uses a plurality of printing agents of color tones among which at least one color tone is different from the color tone of said printing agent used by said first printing head.

19. A printing apparatus as claimed in claim 11, wherein said printing head performs a printing by ejecting the inks.

20. A printing apparatus as claimed in claim 19, wherein said printing head has heating elements for generating thermal energy which allows the inks film-boiling as an energy used for ejecting the inks.

21. A printing system provided with a printing apparatus for performing an image printing on a printing medium by a first printing and a second printing with predetermined conditions of a dot forming position by using a printing head, and a host apparatus for supplying an image data to said printing apparatus, comprising:

a first pattern forming means for forming a plurality of patterns respectively having different area factor of dot formation area is different by said first and/or second printing of said print head;

a first measuring means for measuring respective optical characteristics of said plurality of patterns formed;

a function determining means for determining a function showing the relationship between the printing position offset between said first and second printings and the optical characteristics, on the basis of the measured optical characteristics;

a second pattern forming means for forming a pattern having a predetermined area factor of dot formation area by said first printing and second printing;

a second measuring means for measuring the optical characteristics of the pattern formed by said second pattern forming means; and an adjustment value acquiring means for acquiring an adjustment value of a dot forming position condition between said first printing and said second printing, by applying the optical characteristics measured by said second measuring means to said function.

22. A storage medium which is connected to an information processing apparatus and a program stored in which is readable by the information processing apparatus, said program being for making a printing system to perform a method for performing printing registration in a first printing and a second printing with respect to a printing apparatus which performs printing of an image on a printing medium by said first printing and said second printing with predetermined conditions of a dot forming position by using a printing head, said method comprising:

a first pattern forming step of forming a plurality of patterns respectively having different area factor of dot formation area by said first and/or second printing using said print head;

a first measuring step of measuring respective optical characteristics of said plurality of patterns formed;

a function determining step of determining a function showing the relationship between the printing position offset between said first and second printings and the optical characteristics, on the basis of the measured optical characteristics;

a second pattern forming step of forming a pattern having a predetermined area factor of dot formation area by said first printing and second printing;

a second measuring step of measuring the optical characteristics of the pattern formed by said second pattern formation step; and an adjustment value acquiring step of acquiring an adjustment value of a dot forming position condition between said first printing and said second printing, by applying the optical characteristics measured by said second measuring step to said function.

* * * * *

UNITED STATES PATENT AND TRADEMARK OFFICE

CERTIFICATE OF CORRECTION

PATENT NO. : 6,257,143 B1
DATED : July 10, 2001
INVENTOR(S) : Osamu Iwasaki et al.

It is certified that error appears in the above-identified patent and that said Letters Patent is hereby corrected as shown below:

Column 4,
Line 5, "has" should read -- have --.

Column 5,
Line 60, "respective" should read -- respect --.

Column 10,
Line 3, "printings" should read -- printing --; and
Line 4, ", the" should be deleted.

Column 11,
Line 6, "FIGS. 6A" should read -- FIG. 6A --; and
Line 10, "able" should read -- able to --.

Column 15,
Line 13, "procedures" should read -- procedure --.

Column 16,
Line 24, "elements" should read -- element --.

Column 22,
Line 21, "a" (second occurrence) should be deleted.

Column 30,
Line 41, "can" should be deleted.

UNITED STATES PATENT AND TRADEMARK OFFICE

CERTIFICATE OF CORRECTION

PATENT NO. : 6,257,143 B1
DATED : July 10, 2001
INVENTOR(S) : Osamu Iwasaki et al.

It is certified that error appears in the above-identified patent and that said Letters Patent is hereby corrected as shown below:

Column 33,
Line 12, "by" (second occurrence) should be deleted.

Signed and Sealed this

Second Day of April, 2002

*Attest:*

*Attesting Officer*

JAMES E. ROGAN
*Director of the United States Patent and Trademark Office*